US011641700B2

(12) United States Patent
Laghi

(10) Patent No.: US 11,641,700 B2
(45) **Date of Patent: *May 2, 2023**

(54) INDUCTION HEATER AND DISPENSER

(71) Applicants: Alps South Europe S.R.O., Pizen (CZ); Aldo Laghi, Pinellas Park, FL (US)

(72) Inventor: Aldo Laghi, Pinellas Park, FL (US)

(73) Assignee: Alps South Europe, S.R.O.

( * ) Notice: Subject to any disclaimer, the term of this patent is extended or adjusted under 35 U.S.C. 154(b) by 60 days.

This patent is subject to a terminal disclaimer.

(21) Appl. No.: 17/245,593

(22) Filed: Apr. 30, 2021

(65) Prior Publication Data

US 2021/0249795 A1 Aug. 12, 2021

Related U.S. Application Data

(63) Continuation of application No. 15/489,363, filed on Apr. 17, 2017, now Pat. No. 9,859,627, and a (Continued)

(51) Int. Cl.

| | |
|---|---|
| ***H05B 6/00*** | (2006.01) |
| ***H05B 6/10*** | (2006.01) |
| ***H05B 6/06*** | (2006.01) |
| ***A45D 27/00*** | (2006.01) |
| ***H01R 4/18*** | (2006.01) |
| ***H01R 11/12*** | (2006.01) |
| ***H01R 11/32*** | (2006.01) |

(Continued)

(52) U.S. Cl.

CPC ..... *H05B 6/06* (2013.01); *A45D 27/00* (2013.01); *B05B 9/002* (2013.01); *B67D 7/82* (2013.01); *H01R 4/185* (2013.01); *H01R 11/12* (2013.01); *H01R 11/32* (2013.01); *H05B 6/105* (2013.01); *A45D 2200/155* (2013.01)

(58) Field of Classification Search

CPC . H05B 6/02; H05B 6/06; H05B 6/802; H05B 6/40; H05B 6/42; H05B 6/108; H05B 6/62; H05B 6/062; H05B 6/105; H05B 6/106; H05B 6/36; B67D 7/82; H01R 11/12; H01R 11/32; H01R 4/185; A45D 27/00; A45D 2200/155; A45D 44/00; A45D 44/008; B05B 9/002

USPC ..... 219/214, 618, 625, 628, 634, 635, 674

See application file for complete search history.

(56) References Cited

U.S. PATENT DOCUMENTS

2008/0047948 A1* 2/2008 Rosenbloom ..... A47J 36/26 219/386

2008/0257880 A1* 10/2008 Brown ..... H05B 6/108 219/618

(Continued)

*Primary Examiner* — Hung D Nguyen

(74) *Attorney, Agent, or Firm* — Cole Carlson

(57) ABSTRACT

An induction heating device for heating and/or melting a heat affected product zone of shaving or cosmetic products stored in a product container which consists of a layer of the product heated by an electrically conductive metallic target member having through-passages overlying the top product surface and energized by an induction coil into which an electromagnet field is generated by electronic circuitry for a predetermined time period into the product container, thereby permitting the heated and or melted product to flow through the through-passages onto the top surface of the target member to be collected by a user for shaving or cosmetic purposes.

19 Claims, 28 Drawing Sheets

Related U.S. Application Data continuation of application No. 15/131,126, filed on Apr. 18, 2016, now Pat. No. 9,743,463.

(51) Int. Cl.
*B05B 9/00* (2006.01)
*B67D 7/82* (2010.01)

(56) References Cited

U.S. PATENT DOCUMENTS

2014/0091083 A1* 4/2014 McGarvey ..... H05B 6/36 219/634
2015/0195871 A1* 7/2015 Duffield ..... A61L 9/035 219/634
2015/0223292 A1* 8/2015 Duffield ..... A61L 9/037 219/634
2015/0250028 A1* 9/2015 Duffield ..... A01M 1/2077 219/634
2016/0158397 A1* 6/2016 Duffield ..... A01M 1/2061 219/634

* cited by examiner

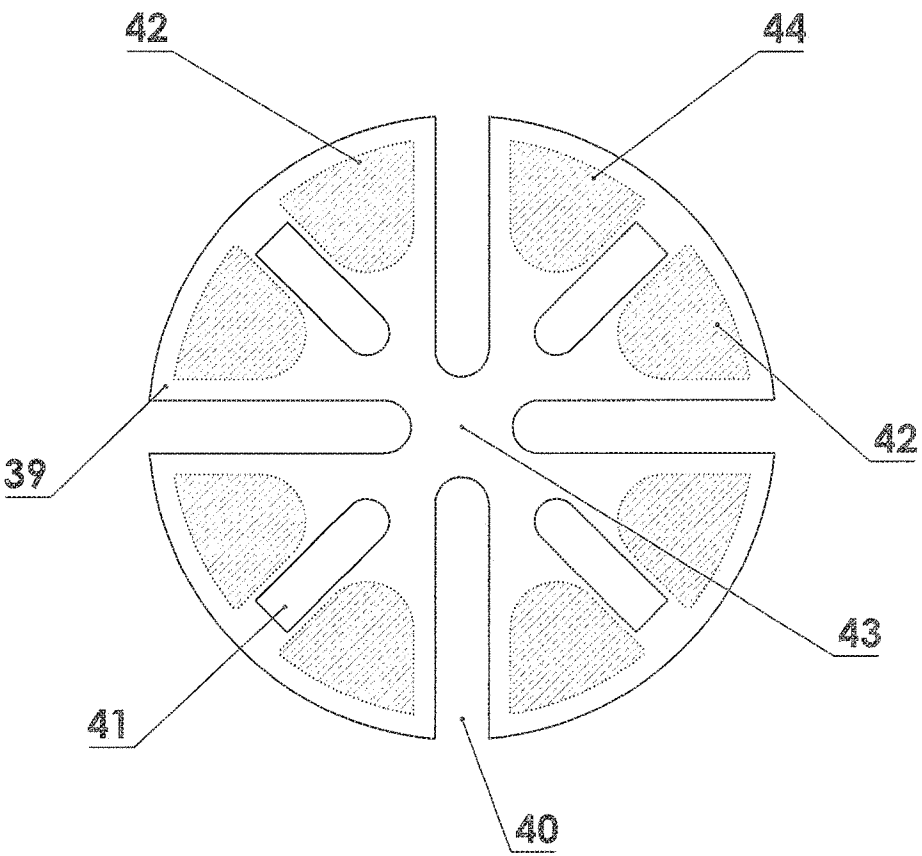
Fig 13
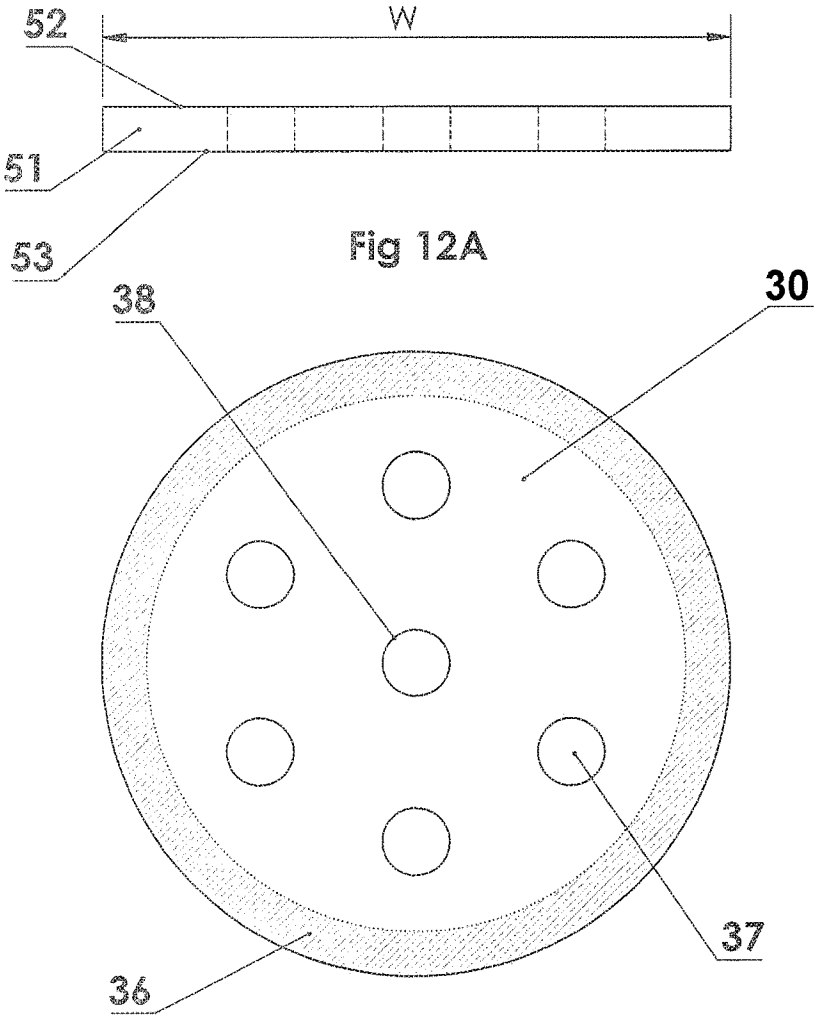
Fig 12
Fig 12A

INDUCTION HEATER AND DISPENSER

CROSS-REFERENCE TO RELATED APPLICATIONS

This application is a continuation of Ser. No. 15/490,363 filed Apr. 18, 2017 entitled "Induction Heater and Dispenser" which is a continuation of Ser. No. 15/131,126 filed Apr. 18, 2016 entitled "Induction Heating Device for Shaving and Cosmetic Applications" which claims the benefit of Ser. No. 62/365,745 filed on Jul. 22, 2016 entitled "Induction Heater and Dispenser" and which is also a continuation-in-part of Ser. No. 14/341,696 filed Jul. 25, 2014 and PCT/US15/50991 filed Sep. 18, 2015, the disclosures of which are hereby incorporated by reference herein.

This application claims the benefit of Ser. Nos. 62/421,164 filed Nov. 11, 2016 and 62/365,745 filed on Jul. 22, 2016 and entitled "Induction Heater and Dispenser," the disclosures of which are hereby incorporated by reference herein.

This application also claims the benefit of Ser. No. 62/365,745 filed Jul. 22, 2016 entitled "Induction Heater and Dispenser", the disclosure of which is hereby incorporated by reference herein.

BACKGROUND OF THE INVENTION

Field of the Invention

This disclosure relates to an induction heater able to generate an electromagnetic field into a container housing a target workpiece which, in turn, generates heat which is transferred to a small portion of the material contained within the removable container.

Description of the Background Art

Basic principles of induction heating date back to Michael Faraday's work in 1831. Induction heating is the process of heating an electrically conductive object by electromagnetic induction, where eddy currents are generated within the target workpiece. This technology is widely used in industrial welding, brazing, bending, and sealing processes. Also, induction heating has grown very popular in culinary applications, providing a more efficient and accelerated heating of liquids and/or foods on stovetops or in ovens. Advantages of using an induction heating system are an increase in efficiency by using less energy and also generating heat to a specific target workpiece.

Many varieties of dispensers exist for providing a volume of material to the operator. These are readily seen in household, industrial, and commercial uses. In each instance pressure is generated which, as a result, displaces a volume of material. These mechanisms are referred to as pumps.

Additionally, a variety of heaters exist that generate heat and transfer said heat to a material. Some common methods include resistive, radiative, and induction heating.

The most common heating is resistive heating in which an element is heated through the passage of current through a conductive resistor. The heat generated is then transferred to the material either through convection or conduction. These systems are common, inexpensive, but lack efficiency due to the indirect heating that occurs. In resistive systems, the vessels that contain the heated material require regular cleaning. Because of the simplicity of this heating system it is generally the most inexpensive system of all heating methods. A disadvantage of this heating method is that material change out requires careful cleaning to avoid cross-contamination or alternatively, separate systems per material type.

One attempt of using an induction heating system is disclosed by Brown, et al. in US 20080257880 Al. Brown, et al. disclose an induction heating dispenser having a refill unit 8 heated by primary and secondary induction coils 2 and 13. As disclosed in paragraph [0020], the dispenser can be used for many different applications such as air fresheners, depilatory waxes, insecticides, stain removal products, cleaning materials, creams and oils for applications to the skin or hair, shaving products, shoe polish, furniture polish, etc. The refill unit 8 comprises a multiplicity of replaceable containers 9 for holding the respective products. The containers are sealed under a porous membrane 11. As disclosed in paragraph [0011], the porous membrane is usually removed for meltable solid substances. For volatile liquid substances, the porous membrane is not removed. As disclosed in paragraph [0023], the porous membrane 11 has a porosity that allows vapor to pass through but not liquid to prevent spillage. Also, in paragraph [0020], for heated products that are applied to a surface, the container may have an associated applicator such as a brush, pad or sponge.

Another heated dispenser system is disclosed by Bylsma, et al. in US 20110200381 Al. Bylsma, et al. discloses a dispenser wherein the heating unit could be either in the base unit 10 as illustrated in FIG. 4, or in the applicator 42 as illustrated in FIG. 5. As disclosed in paragraph [0026], the heating unit may be an inductive power coupling. As disclosed in paragraphs [0030-0036], the applicator may be of many different forms depending on the product to be dispensed.

The present invention utilizes induction to heat a target workpiece residing within an induction cavity of a removable material container. The induction cavity is sized such that the volume contained therein is proportional to the amount needed per application. It should be noted that the volume contained in the induction cavity is the only volume heated during the heating cycle of the present invention. Advantageously, this immediately provides the user with heated material for each application and the ability for rapid material change into and out of the induction dispenser without risk of cross-contamination.

Within the field of induction heating the temperature of the target workpiece is generally controlled by the time and relative strength of the electromagnetic field. In some instances a means of feedback relating the target workpiece temperature is provided to the induction control circuit by a sensor external to the target workpiece. Generally, the sensor is wired directly to the induction heater. Due to the complexity and inherent unreliability, the integration of target workpiece temperature control into an induction heater has been relinquished to a trial and error process. However, one such temperature controlled induction system is described in U.S. Pat. No. 9,066,374 by Warren S. Grabber. Said prior art by Grabber discloses an induction heating device that utilizes a temperatures sensor that is mounted to the bottom inside surface of the holding device. A pan functions as the target workpiece and contacts said temperature sensor when placed within the induction heating device. Heat from the pan is conducted to the temperature sensor and is measured accordingly. Drawbacks with such a system are as follows; Contact must be maintained between the temperature sensor and target workpiece vessel. Should interference occur the measurement would be incorrect and the actual temperature much higher than the measured temperature. Such sensors are susceptible failure due to contaminants, spills, or general cleaning cycles. Depending on the geometry and material of the target workpiece, areas of higher localized heat, "hot spots," will occur. In fact, the target workpiece area that is measured by said temperature sensor would be a "cold spot" on said target workpiece due to the coil configuration that is configured to accommodate said temperature sensor. In other words, by using a temperature sensor the induction coil cannot occupy the space occupied by the temperature sensor and therefore heat is not generated in that area of the target workpiece. Thus the temperature at the hottest location of the target workpiece and the temperature measured by the temperature sensor have significant difference.

Within the field of induction heating, target workpiece temperature control has been relegated to either relative measurements or in some cases a maximum temperature such as the teaching in U.S. Pat. No. 8,263,916 by Hagino Fujita, hereinafter "Fujita." Fujita presents an induction target workpiece that is incorporated into a container for heating foods and the like. The target workpiece is configured with "separation sections." Said separation sections break when the high frequency electromagnetic field create eddy current strong enough in said separation sections to cause failure or breakage. As a result, the target workpiece becomes unusable. Said separation sections are created by folds in the target workpiece. The novelty of this invention relies on a coil configuration that creates eddy current flow radially. Additionally, the "separation section functions essentially as a thermal fuse. As such, the induction heating device that develops the high frequency electromagnetic field would need to be adjusted so as to prevent immediate destruction of the invention should the field be too strong. Additionally, it should be noted that said separation sections create high resistance in their locations which causes them to be higher in temperature than other locations within the target workpiece.

Further, the use of a bellows pump system would be preferable for this type of induction heating system. The assembly described in U.S. Pat. No. 7,793,803 to Neerinex et al., hereinafter "Neerinex," presents an assembly which provides a configuration best suited for introduction of the target workpiece. The assembly allows for the compression and decompression of the bellows which, in concert with the system described herein, allows for the easy production of heated material. Additionally, it should be noted that Neerinex requires substantive modification to the valve portion of the assembly in order to provide the proper structure to introduce the target workpiece. While Neerinex provides the optimal pump system for the induction heating system described herein, other pumps may be used to achieve the desired result. For example, applicators such as those used in caulking guns can be modified for use in the present invention.

Therefore, it is an object of this invention to provide an improvement which overcomes the aforementioned inadequacies of the prior art devices and provides an improvement which is a significant contribution to the advancement of the induction and dispenser art.

Another object of this invention is to provide a dispenser which heats a small amount of material that a user can put on their skin wherein the heated material diffuses into the user's skin at a faster rate due to the higher temperature.

Another object of this invention is to provide a dispenser wherein the material can be gel, liquid or solid.

Another object of this invention is to provide a dispenser which uses a small target workpiece made out of aluminum or similar conductive metal for use with induction heating which may or may not also be coated in plastic or similar material so as to prevent oxidation of the target workpiece.

Another object of this invention is to provide a dispenser which automatically dispenses material through the use of a motion sensor.

Another object of this invention is to provide a dispenser which quickly heats only the volume of material to be dispensed, leaving the remainder of the material within in the container at room temperature thereby avoiding degradation of certain materials and for easy removal of the container even directly after heated material has been dispensed.

Another object of this invention is to provide an induction cavity wherein the induction cavity is comprised of a channel to control the flow of the material to be heated. Within said channel, the material is heated against the target workpiece. This heating action occurs during the dispensing of the material from the container.

Another object of this invention is to provide an induction cavity wherein the target workpiece is configured to evenly distribute heat across the maximum surface area of said target workpiece.

Another object of this invention is to provide a product container that houses a target workpiece that is configured to provide feedback to the induction dispenser regarding the temperature of the target workpiece.

Another object of this invention is to provide a product container with a target workpiece that mechanically limits the maximum heat provided to the material during and due to consecutive heat cycles.

Another object of this invention is to provide an induction dispenser that detects the change of the target workpiece within the container as a change in tank frequency.

Another object of this invention is to provide an induction dispenser that controls parameters of the heating cycle based on the inductance of the coil.

The foregoing has outlined some of the pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

The present invention relates generally to an induction heater for warming products such as soaps, creams, lotions, gel compositions, or other solutions (hereinafter "material") for use on the skin. The material is stored in a container wherein only a certain volume of the product is heated and/or melted by an induction-heating device. An electrically conductive metallic workpiece, also known as the "target workpiece," is positioned within an induction cavity preferably placed between a dispensing mechanism and an outlet. The target workpiece may also be located before the dispensing mechanism or the system may have multiple target workpieces working in concert with one another. The induction heater preferably uses a motion sensor which causes the dispensing mechanism to dispense material through the induction cavity. The heated target workpiece then warms the material on its way to the outlet. Another embodiment of the induction heater has it heating a top layer of material.

The dispenser preferably has a housing with an induction coil housing. The induction coil housing is an electromagnetic heating circuit and an induction coil with an aperture for the reception of a material container. The induction coil is disposed in parallel relation to the induction cavity within the material container as described hereinafter. A user interface is also mounted on a front surface of the housing for controlling the dispensing of material and the warming and/or melting and/or liquefying of the material for dispensing. Although the preferred shape of the target workpiece is disc-shaped, other geometric shapes may also be employed such as square-shaped or rectangular-shaped depending on the shape of the product container as discussed in more detail hereinafter. The present invention is a more effective means of heating the product; especially for an amount necessary for the immediate application since only the product in the induction cavity is heated and/or melted. As different products may be stored in different containers, the containers of product are easily accessible and interchangeable from the induction receptacle. A unique RFID tag can be incorporated into each material container to allow the material and associated target workpiece to be uniquely identified by the induction system having an RFID reader to provide the necessary heating according to the advantages of the present invention. The present invention has no open flame, operates silently, and stays cool after the container is removed. Furthermore, the product will return to its original form (e.g., solid, cream or gel) more quickly than if the entire product was melted, minimizing degradation of the product.

Another arrangement involves storing the products in a container wherein only the upper portion of the product is heated and/or melted by an induction-heating device. An electrically conductive metallic target workpiece (hereinafter "target workpiece") having through-passages is positioned generally on the top surface of the product within the product container. As the target workpiece becomes heated by the induction system, the heated and/or melted product flows through the through-passages. The present invention instantaneously heats only a portion or volume of product necessary for immediate application by the user. The induction-heating device comprises a housing with a top outer surface defining an induction receptacle. Mounted within said housing is an electromagnetic heating circuit and an induction coil. The induction coil is disposed in parallel relation to the induction receptacle as described hereinafter. A user interface is also mounted in the top surface of the housing for controlling the warming and/or melting or liquefying the product in the "heat affected product zone". The device includes an induction receptacle that accepts a product container filled with a product. The electromagnetic heating circuit and induction coil generate an electromagnetic field within the product container that induces eddy currents into the target workpiece thereby heating the target workpiece. The present invention may be further characterized in that the induction coil may have various configurations as described in further detail hereinafter for varying the electromagnetic field. Inside the product container, the target workpiece is disposed across the top surface of the product. The target workpiece comprises through-passages for allowing heated and/or melted product to flow therethrough. The heat generated in the target workpiece is then conducted to the "heat affected product zone" of the product to heat and/or melt or liquefy only the product in the "heat affected product zone". The target workpiece then acts as an interface between the user (or user's brush, pad, cloth, finger, and the like) and the product. The target workpiece may be comprised of various geometric configurations that allow the user to stir or agitate different products to the desired temperature and/or consistency. In applications requiring the product to be heated (such as cosmetics, lotions, creams, balms, waxes, etc.), the target workpiece would be predominantly flat. In applications requiring the product to be heated and lathered, the target workpiece would be comprised of non-flat geometry including raised portions or indentions depending on orientation of the target workpiece within the product receptacle. Alternative to a relatively flat profile, the target workpiece may be dish-shaped, cup-shaped or corrugated-shaped. The target workpiece may comprise an electrically conductive disc made of a metal screen, a metal plate perforated with holes, slots or a combination of holes and slots, all of which provide through-passages to allow product to pass therethrough. Although the preferred shape of the target workpiece is disc-shaped, other geometric shapes may also be employed such as square-shaped or rectangular-shaped depending on the shape of the product container as discussed in more detail hereinafter. As the product in the heat affected product zone is only heated and/or melted, an applicator such as a shaving brush or skin pad can be used to collect the heated and/or melted product from the upper surface of the target workpiece which can be applied to the face or any other desired location of the body. The present invention is a more effective means of heating the product; especially for an amount necessary for the immediate application since only the product in the heat affected product zone is heated and/or melted. As different products may be stored in different containers, the containers of product are easily accessible and interchangeable from the induction receptacle. A unique RFID tag is incorporated into each product container to allow the product and associated target workpiece to be uniquely identified by the induction system to provide the necessary heating according to the advantages of the present invention. The present invention has no open flame, operates silently, and stays cool after the container is removed. Furthermore, the product will return to its original form (e.g., solid, cream or gel) more quickly than if the entire product was melted, minimizing degradation of the product.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

FIGS. 12 through 20 show various embodiments of target workpieces.

Similar reference numerals refer to similar parts throughout the several views of the drawings.

DETAILED DESCRIPTION OF THE PREFERRED EMBODIMENT

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Figure 1:
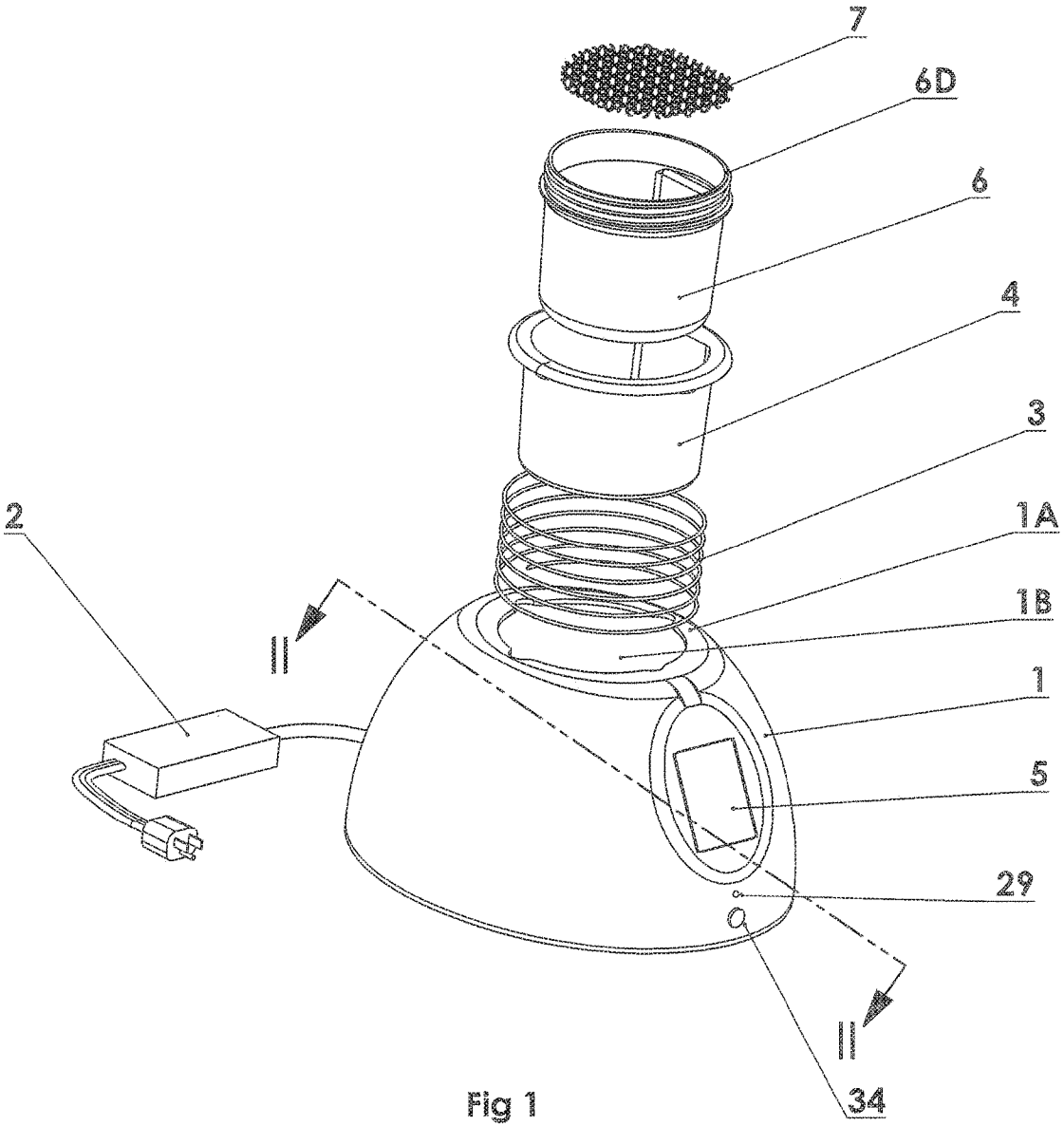
FIG. 1 is an exploded view of a first embodiment of the present invention's trapezoidal-shaped housing.

As illustrated in FIG. 1, an exploded view of a first embodiment of the present invention basically includes an induction heating unit main housing (1) connected to a power supply (2). In describing the structure of the present invention, elements common to each embodiment will be given the same numerals. The main housing (1) has a top outer surface (1A) with an opening (1B). An induction receptacle (4) is mounted in the main housing (I) through opening (1B). An induction-heating coil (3) is mounted adjacent the induction receptacle (4). A product container (6) is removably inserted within the induction receptacle (4). In this first embodiment, the product container (6) includes flange (6D) for receiving a closure (not shown) such as a conventional foil adhered to the flange.

Figure 2:
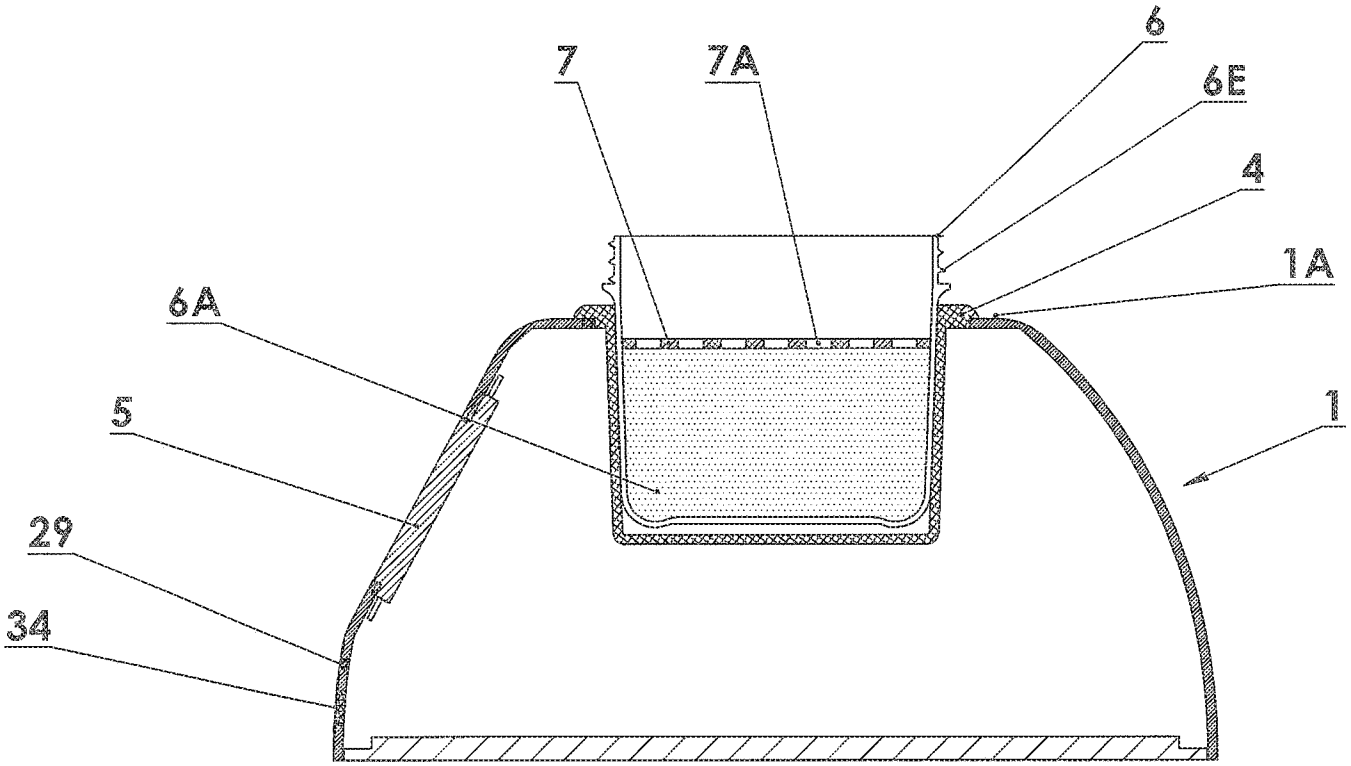
FIG. 2 is a cross-sectional view along the lines 11-11 shown in FIG. 1
Figure 3:
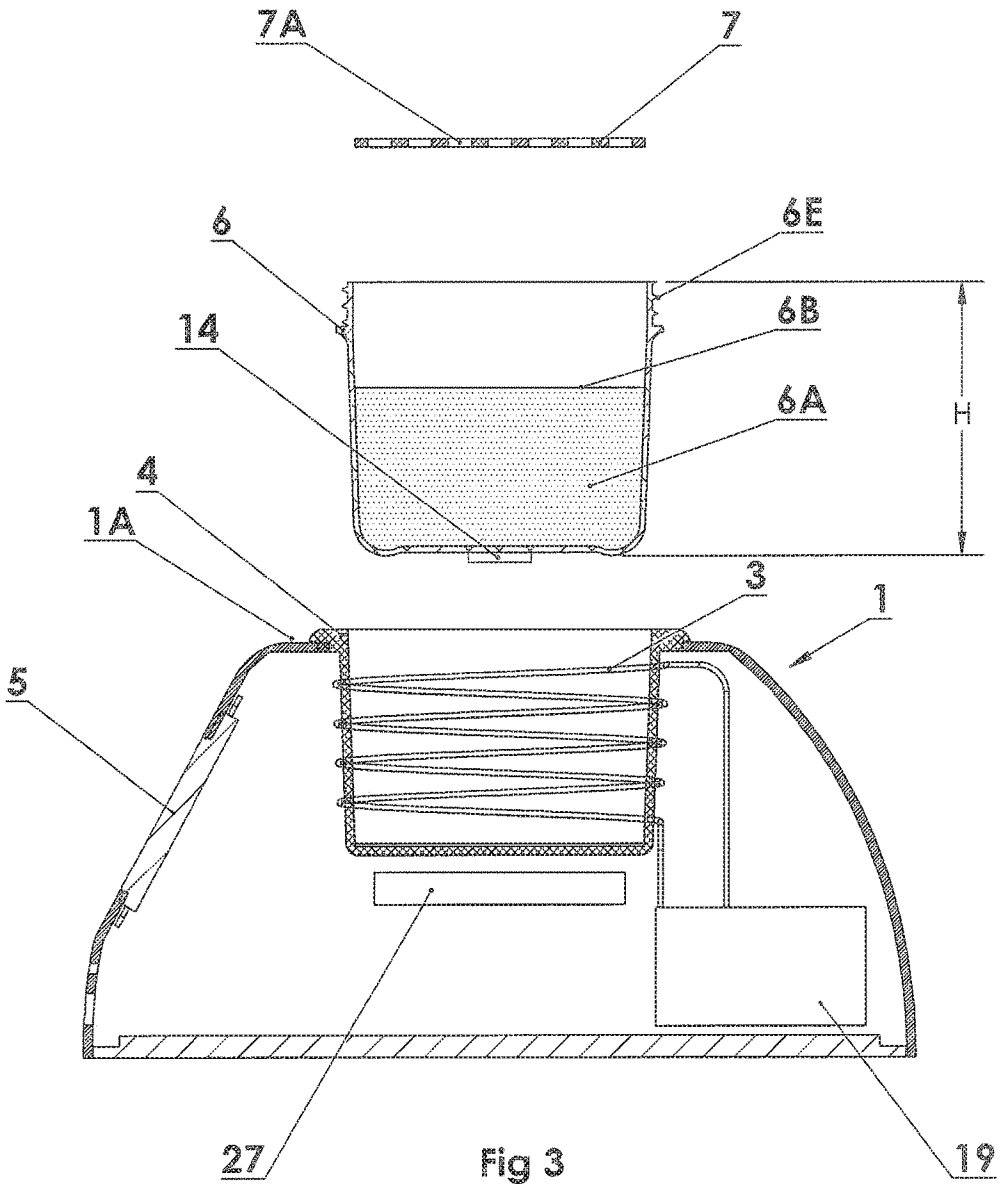
FIG. 3 is a cross-sectional view along the lines 11-11 shown in FIG. 1 inclusive of the induction heating system.

Referring to FIGS. 2 and 3, illustrated are cross-sections along lines 11-11 indicated in FIG. 1. The induction receptacle (4) has an open top extending through the top surface (1A). The induction-heating coil (3) surrounds the induction receptacle (4) and is controlled by microprocessor (19). The preferred diameter of the container is between 2 and 4 inches (5.08 and 10.16 cm). Illustrated as (H) in FIG. 3, the height of the container is between 0.5 to 2 times the diameter of the container. Although the induction receptacle and product container are illustrated in the form of cylindrically shaped containers, the shape of the induction receptacle and product container is not intended to be so limited and other geometric configurations may be employed. Also, the product container (6) shown in FIGS. 2 and 3 includes an upper threaded extension (6E) for receiving a threaded closure (not shown).

Referring to FIG. 3, an RFID tag (14) is mounted on or in the bottom surface of the product container (6) for transmitting data to the RFID reader (27) which translates information to the microprocessor (19) such as cycle time, resonant frequency of target workpiece, product type, and other parameters needed to heat the product according to requirements. To ensure the key objectives of the present invention, i.e., immediate heating of the product for an application and to minimize the degradation of the product, the present invention requires the successful transmission of the information from the RFID tag (14) to the RFID reader (27). A conductive target workpiece (7) having through-passages (7A) is removably inserted within product container (6) and initially rests on the upper product surface (6B) of an unheated product (6A) contained within the container. By using the terminology "conductive target workpiece" herein is meant that it is the only structural element of the present invention within the product container (6) that is heated by the induction-heating coil (3). The heat from the "conductive target workpiece" is then transferred to the "heat affected product zone" as described hereinbefore. As explained and emphasized in further detail hereinafter, the cycle time is adjusted to heat and/or melt the product only in the "heat affected product zone" thereby allowing product to flow through the through-passages. Once the cycle time is completed and the product cools and returns to its initial state, the target workpiece remains embedded within the upper surface region of the product. The materials used to manufacture the main housing (1), induction receptacle (4) and product container (6) are non-metallic and non-electrically conductive. Such materials are well known and may include any type of well-known polymeric composition. With the selection of materials used to manufacture the present invention and the operation of the present invention as described hereinafter, the heated target workpiece (7) heats and/or melts the product only in the "heat affected product zone". The product itself is not heated directly by the induction heater coil (3). Also shown is operator interface or user interface window (5) in a side surface of housing (1) that allows the user to interact with the device through visual and touch based actions. The target workpiece (7) in the embodiment illustrated in FIG. 1 is an electrically conductive metallic screen. The interstices between the metallic strands of the screen constitute through-passages. It is noted that the target workpiece (7) comprises a geometry to nest within the product container (6), which comprises a geometry to nest within the induction receptacle (4). In other words, the peripheral dimensions of the target workpiece (7) and in all embodiments of the present invention described herein are slightly less than the interior dimensions of the product container whereby the target workpiece is free to fall within the product container as the product diminishes with each use. Also, the outer peripheral dimensions of the product container are slightly less than the interior dimensions of the induction receptacle.

Figure 4:
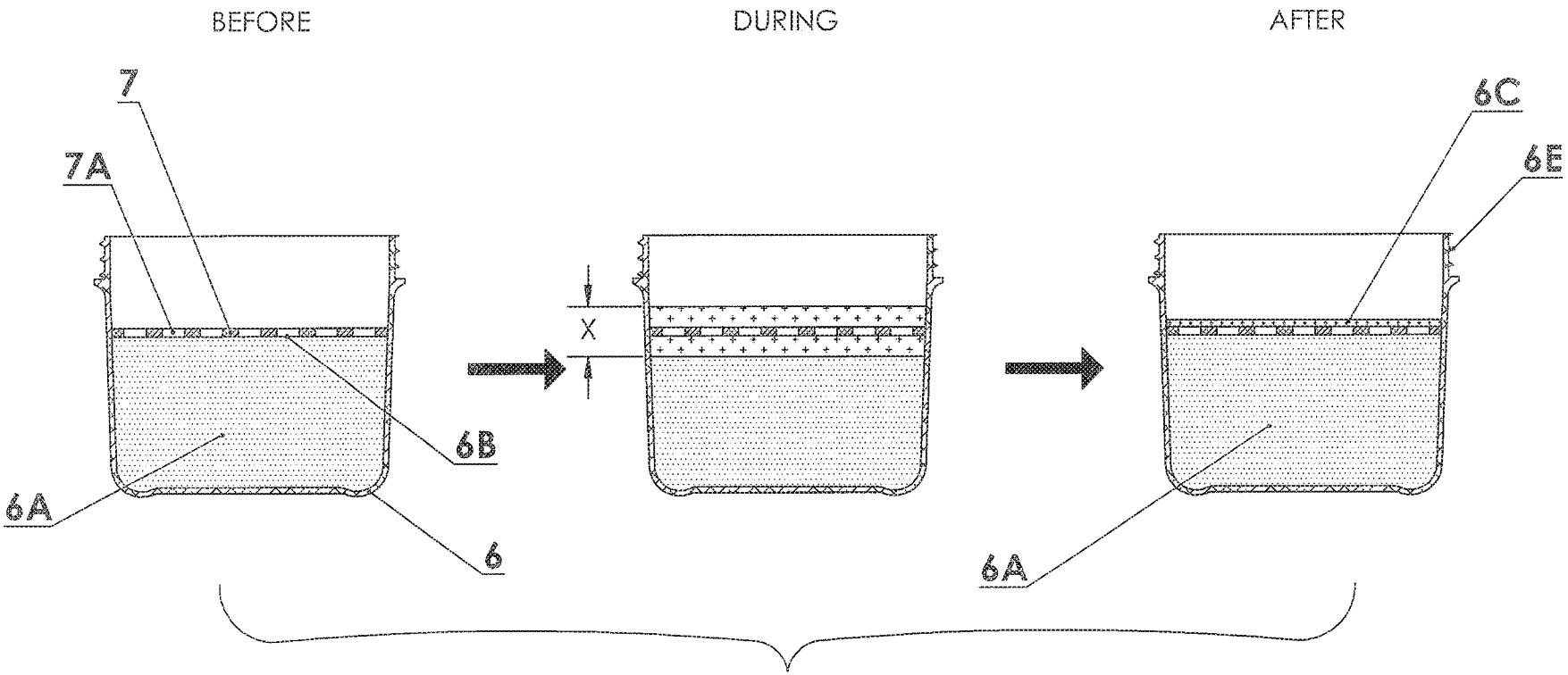
FIG. 4 illustrates the stages that a product within a product container undergoes during a single heating cycle.
Figure 5B:
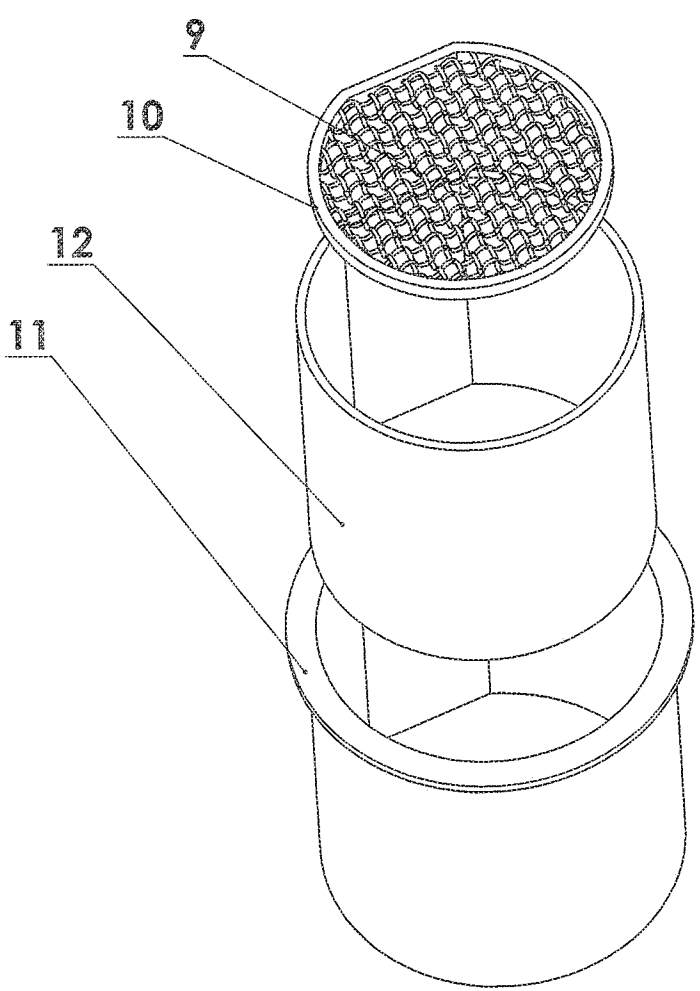
FIG. 5B is an exploded view of the second embodiment of the present invention illustrated in FIG. 5A.
Figure 5A:
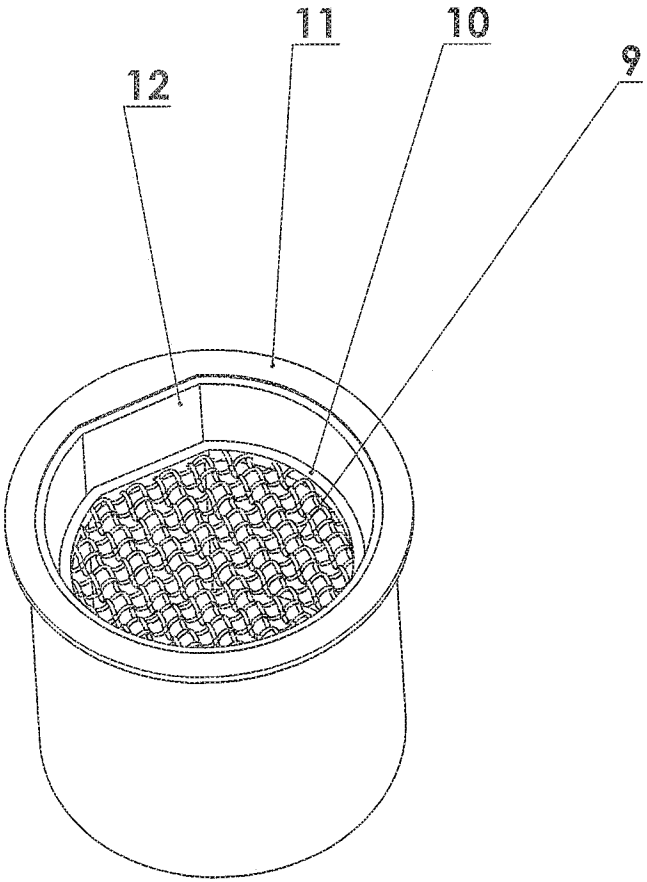
FIG. 5A is a perspective view of a second embodiment of the present invention illustrating an assembled induction receptacle, product container and target workpiece comprising a screen bound by a floatation ring.

Referring to FIG. 4, the stages that the product undergoes during a heating cycle are illustrated. The region or volume within the product container that is only heated during each stage of a heating cycle is the "heat affected product zone" indicated as (X). It is emphasized that this is a key focus of the present invention because only the product in the "heat affected product zone" is heated and not the entire product which would diminish effectiveness of the product over time. In the product container marked "Before", a cross section containing unheated product (6A) is shown with a target workpiece resting on an upper product surface (6B) of the product (6A). In the product container marked "During", the product is heated in the heat affected product zone (X), which is the region immediately above, below, and including the target workpiece in which the product becomes heated and staged for the user. During this stage, as the heating cycle begins, an electromagnetic field passes electromagnetic energy within the target workpiece (described in more detail hereinafter) thereby heating the target workpiece. Heat then transfers to the product that is in contact with the target workpiece. The heated product melts or liquefies and then flows through the target workpiece through-passages (7A) to the upper surface of the target workpiece (7). The heated product located on the upper surface of the target workpiece is then ready for stirring and/or gathering such with a brush, scraper or fingers by the user. During the heat cycle the target workpiece may descend though the product due to gravity or may rely on the downward force by the user. In the product container marked "After", the induction heating cycle has ended and the product and target workpiece begin to cool. As a result the viscosity of the product increases and in some instances the product returns from a liquid state to a solid or gelatinous state. Also, after the product has cooled, a residual layer of product (6C) will remain on the upper surface of the target workpiece (7).

Referring to FIGS. SA and SB, the embodiment illustrated includes a target workpiece (9) illustrated as an electrically conductive metallic screen and floatation device (10) removably inserted within threaded product container (12), which is removably inserted within induction receptacle (11). The threaded product container (12) does not include an upper outwardly extending flange or threaded extension as does the product container (6) in FIGS. 1-4. In this embodiment, a plug-type of closure (not shown) is used to close the product container for storage. The induction receptacle (11) and product container (6) are modified with a non-circular geometry. In particular, each component has at least one flat surface for aligning the components in assembled position and preventing rotation while collecting the product onto the applicator. Although this embodiment is shown to have flat surfaces, any other configuration could be employed to align and prevent rotation of the components during use.

Figure 6:
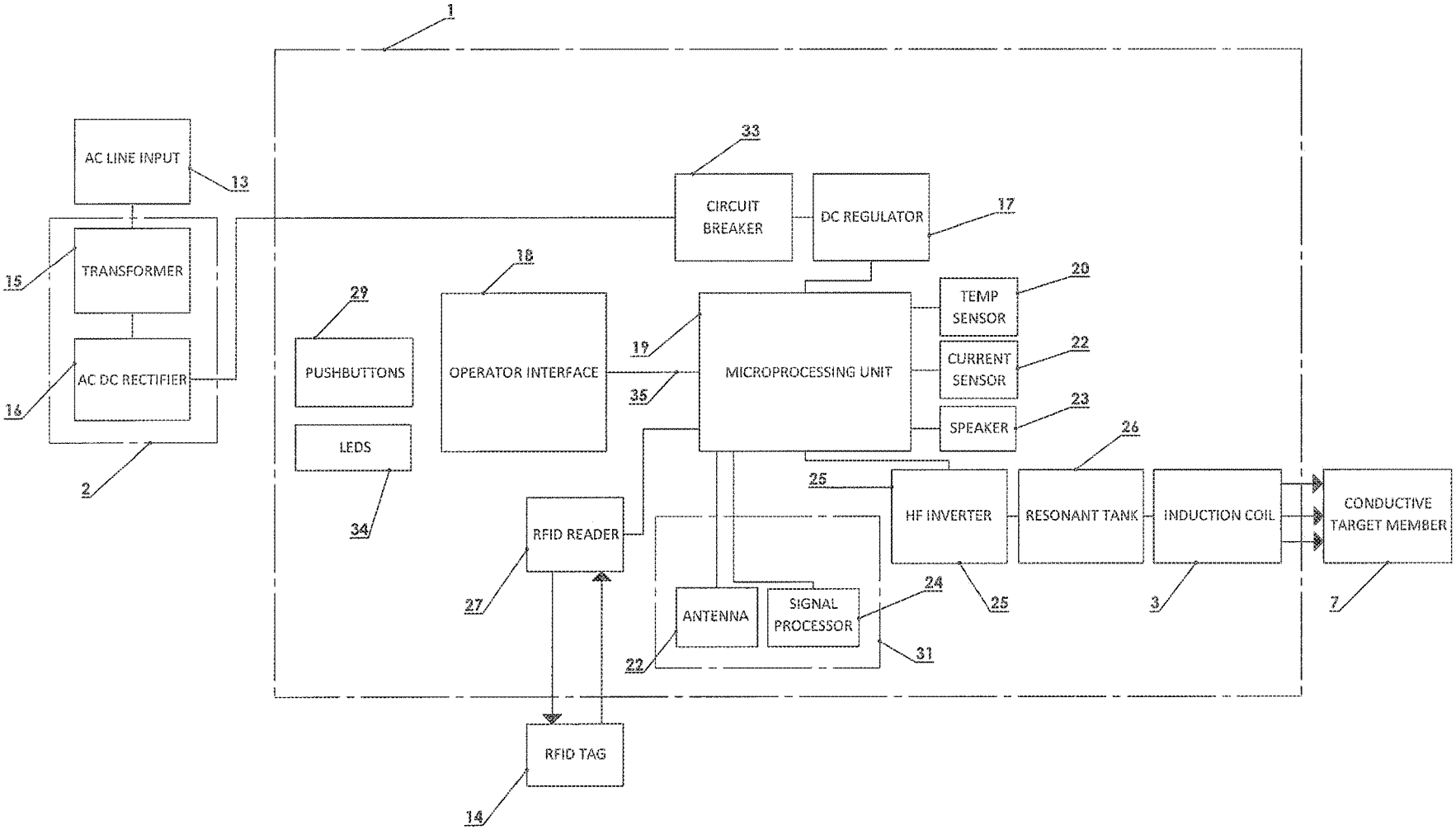
FIG. 6 is a circuit block diagram of the electronic system of the present invention.

Referring to FIG. 6, a circuit block diagram of the present invention is illustrated. A standard wall outlet AC line input (13) is connected to a standard electromagnetic transformer (15) and AC to DC rectifier (16) enclosed within the housing (1) to power the components. The system further includes a standard DC circuit breaker (33) and regulator chip (17) that lowers the voltage to power the sensitive digital components. An operator interface (18) is accessed by window (5) shown in FIGS. 1-3, 8 and 9 enabling a user to interact with the device. A microprocessor unit (19) controls level of electromagnetic energy in the resonant tank (26) described in further detail hereinafter to an induction coil (3). The induction coil (3) is disposed adjacent the induction receptacle (4) shown in FIG. 3. The conductive target workpiece (7) is disposed within the product container (6) that is removably received within the induction receptacle (4). The microprocessor (19) varies the level of heat energy induced into the conductive target workpiece (7) by adjusting the oscillation frequency in the HF converter (25) by means of pulse width modulation (PWM). The microprocessor (19) also controls the operator interface (18), temperature sensor (20), current sensor (21), antenna (22), signal processor (24), RFID reader (27) and electro-acoustic transducer (23). The temperature sensor (20) is capable of reading the internal board component temperatures of the microprocessor as well as the temperatures of the induction coil windings. The current sensor (21) is configured to measure the current draw through the switching circuit within the microprocessor. The antenna (22) can be any conventional type such as a dipole, helical, periodic, loop, etc., and is configured to receive information from remote modules or transmit data to an external remote control device, for example, via Bluetooth technology. The electro-acoustic transducer (23) can be any conventional type, such as a speaker, capable of producing warnings such as over-heating temperatures or other helpful aids to the user throughout the heat cycle. It may also provide instructions during the product application. The transducer may also be configured in such a manner that it records electrical-mechanical pulses and is read by a signal processor (24). The signal processor (24) is a standard signal-processing unit used to decode information received from antenna (22) and transmits information via the electro-acoustic transducer (23). The HF inverter (25) converts DC power to high frequency AC by means of receiving pulse width modulated signals from the microprocessor (19) and receiving high levels of DC power from rectifier (16). The high frequency AC generated by inverter (25) is then passed into a series, parallel, quasi-series, or quasi-parallel resistor, capacitor, and inductor network called a Resonant Tank (26). Tank (26) has a resonant frequency determined by the resistor, inductor, and capacitor (RLC) configuration therein. As current passes through the resonant tank (26), it travels through the induction coil which is a large wound conductive copper induction coil shown as element (3) in FIGS. 1 and 3, as element (3A) in FIG. 8, and as element (3B) in FIG. 9. The RFID reader (27) is mounted within the main housing (1) in close proximity to the bottom of the induction receptacle (4, 4A and 11) in order to communicate with the RFID tag (14) on or in the bottom of the product container (6, 6A or 12). The Resonant Tank (26) frequency is optimized through means of electrical reprogramming and tuning carried out by the microprocessor (19) and high frequency inverter (25). The optimization of the resonant tank is achieved by user input and/or information generated by the RFID tag (14) located on the product container. This system allows the device to deliver precise amounts of current into the induction coil (3) to heat the "conductive target workpiece" (7), which also limits the system from overheating the various components of the system. During the heat cycle and during non-heating idle time the microprocessor (19) monitors the current sensor (21) and temperature sensors (20) to ensure safe operation of the device. The coil is not visible to the outside of housing (1) and surrounds induction receptacle (4) and nested product container (6) with target workpiece (7) resting on the top surface of the product within product container (6). Thus, the target workpiece (7) is closely positioned with respect to the coil (3), which creates an electromagnetic field that passes electromagnetic energy into the conductive target workpiece (7). By this process, the target workpiece only is heated by the electromagnetic energy, which is then transferred to the "heat affected product zone" (X) within the product container. It is again emphasized here that the target workpiece only and not the induction receptacle and product container is heated by the electromagnetic energy. The power supply components as described supra is not intended to be limited as will be described hereinafter.

Figure 7:
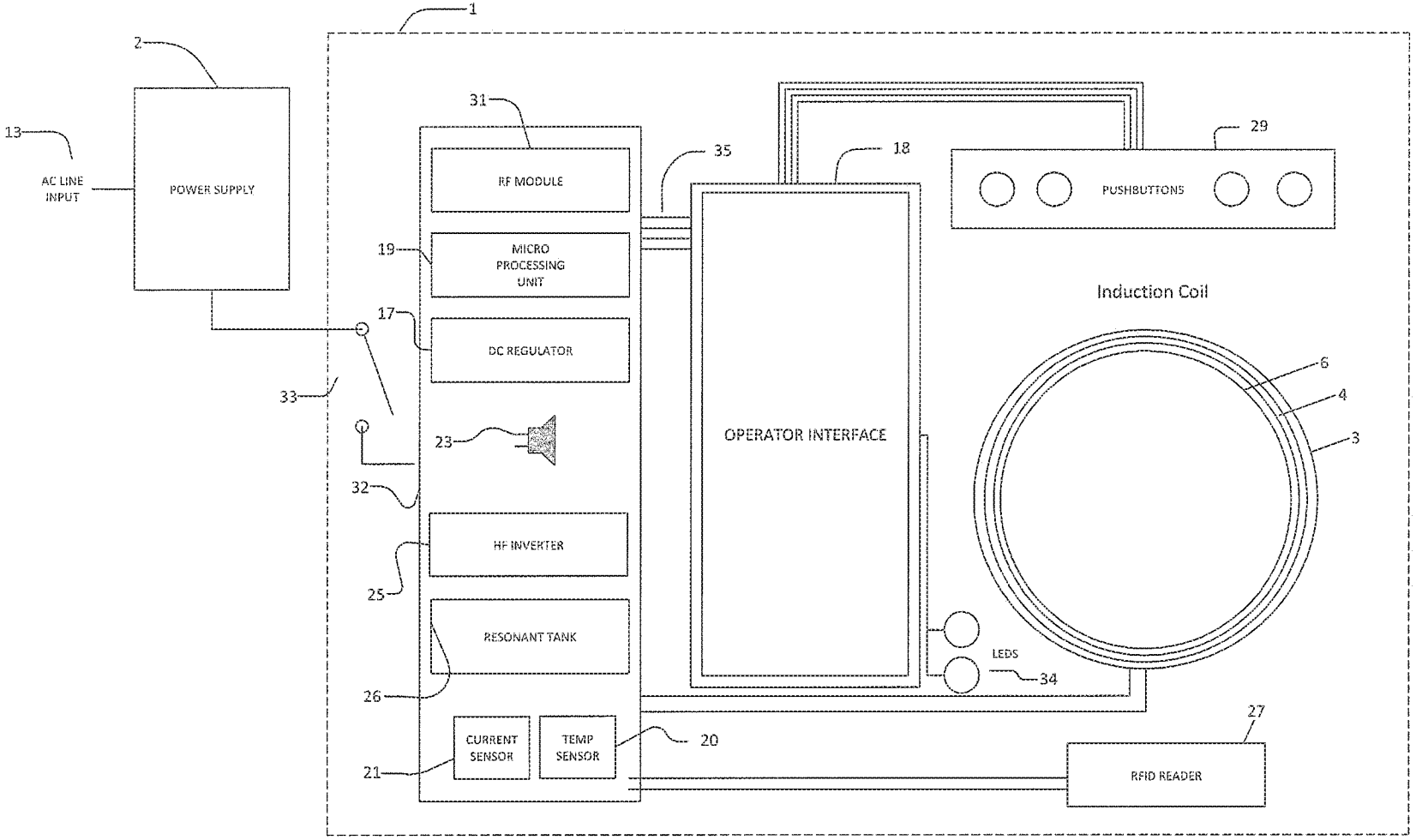
FIG. 7 is a perspective view of the actual arrangement of components within the present invention.

Referring to FIG. 7, a perspective view of how the components illustrated in FIG. 6 are arranged in main housing (1). The RF module (31), which comprises the antenna (22) and signal processor (24) seen in FIG. 6, microprocessing unit (19), DC regulator (17), HF converter (25), resonant tank (26), speaker (23), current sensor (21), temperature sensor (20) are mounted on a main board (32). Power is fed in from a standard electrical wall outlet mains AC at (13). Power fed in is received by power supply (2) which includes transformer (15) and AC-DC rectifier (16) where it is converted into DC power and sent to the remaining components via the DC regulator (17) located on the main board (32). A circuit breaker (33) is utilized as a safety fault in the event of a large current consumption by the device. The operator interface (18) connects into the main board by means of a multi-conductor cable harness (35). The RF module (31) transmits and receives information through antenna (22). Data received and sent passes through a signal processing unit (24) to microprocessor (19). The main board (32) is controlled by microprocessing unit (19). Low voltage DC power is converted from high voltage DC by means of a DC regulator IC chip (17) located on the main board (32). The RFID reader (27) is mounted within housing (1) in close proximity to induction receptacle (4) for communicating with RFID tag (14).

Figure 8:
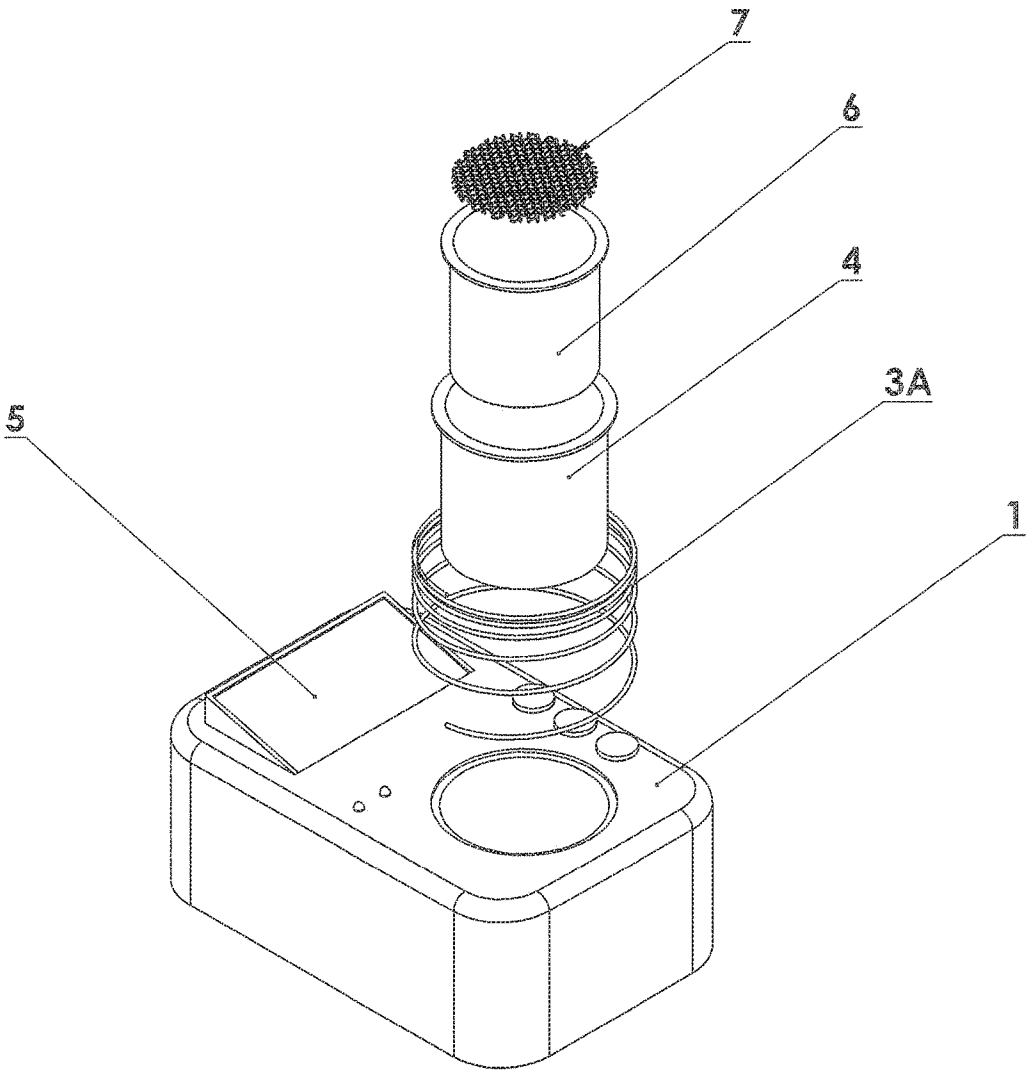
FIG. 8 illustrates an exploded view of a third embodiment of the present invention similar to the first embodiment but with a rectangular-shaped housing and modified cylindrical induction coil configuration.

Referring to FIG. 8, a third embodiment of the present invention is illustrated which is similar to the embodiment illustrated in FIG. 1 with the exception of induction coil (3A) and shape of the main housing (1). The induction coil illustrated in FIG. 2 is configured to have even windings from top to bottom. However, the configuration of the induction coil may be arranged or formed to meet different requirement per product. The embodiment illustrated in FIG. 1 shows an induction coil (3) formed into an evenly pitched helix for relatively even heating of the target workpiece (7 or 9) as it descends from the top of the product container (6) to the bottom. The embodiment illustrated in FIG. 8 shows the induction coil (3A) wound with variable pitch allowing for variable heating as the target workpiece descends in the product container from the top to the bottom. This may advantageously be used to increase, decrease, or make even the heating as the target workpiece descends though the coil. This embodiment may further provide the user with product heated to a higher level when the product container is full. As the product diminishes, the level of heat is reduced to avoid damaging the product from overheating. Thus, the user is provided with uniformly heated product throughout the entirety of product within the product container. It is well known that despite even coil pitch the flux lines of energy may be denser in certain areas, specifically towards the center height of the helix coil. This may be offset by varying the pitch of the helix only in this area. Alternatively, heat generated within the target workpiece may be controlled by indirectly measuring the inductance of the system and varying the frequency thereof. Most preferably, the present invention utilizes the unique RFID tag associated with each product container, associated with each target workpiece, to properly regulate the parameters that relate to the heating cycle. In this embodiment, the main housing has a rectangular shaped housing having interface (S) located on a top surface thereof.

Figure 9:
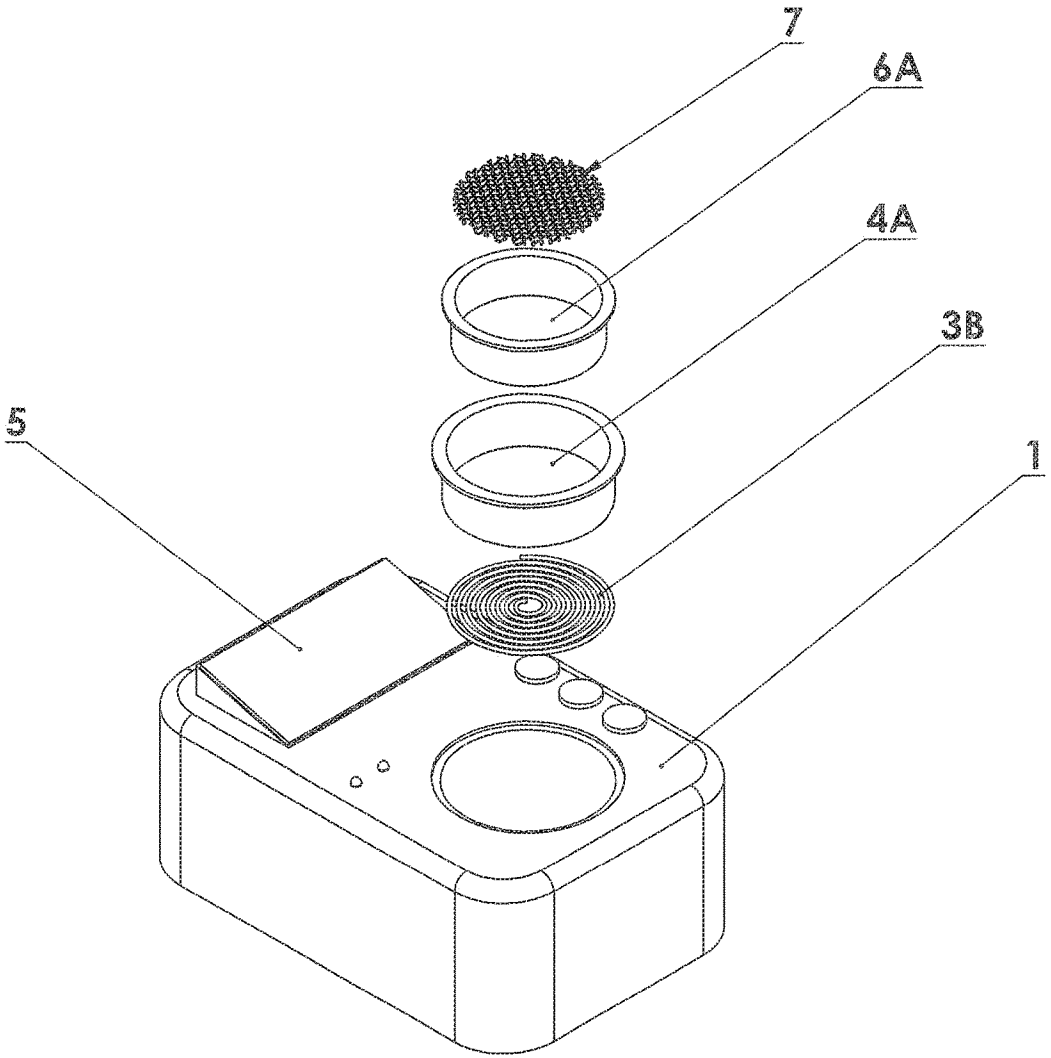
FIG. 9 illustrates an exploded view of a fourth embodiment of the present invention having a modified induction receptacle and product container and a modified coil configuration.

Referring to FIG. 9, a fourth embodiment of the present invention is illustrated which is similar to the embodiment illustrated in FIG. 8 with the exception of the induction coil (3B), which is formed as a pancake coil. Also, the induction receptacle (4A) and product container (6A) have an overall depth much less than the induction receptacles and product containers of the previous described embodiments. All other components are the same as those of the embodiments illustrated in FIG. 2 or 8. The effective height of the electromagnetic field generated by the pancake coil (3A) is much less than that of the cylindrical coils of the previous embodiments thus taking into account the lesser overall depth of the product receptacle (4A) and product container (6A). In other words, the effective distance of the electromagnetic field generated by the pancake coil (3A) is sufficient to heat the target workpiece disposed at an upper region of the product within the product container of lesser height.

Figure 10B:
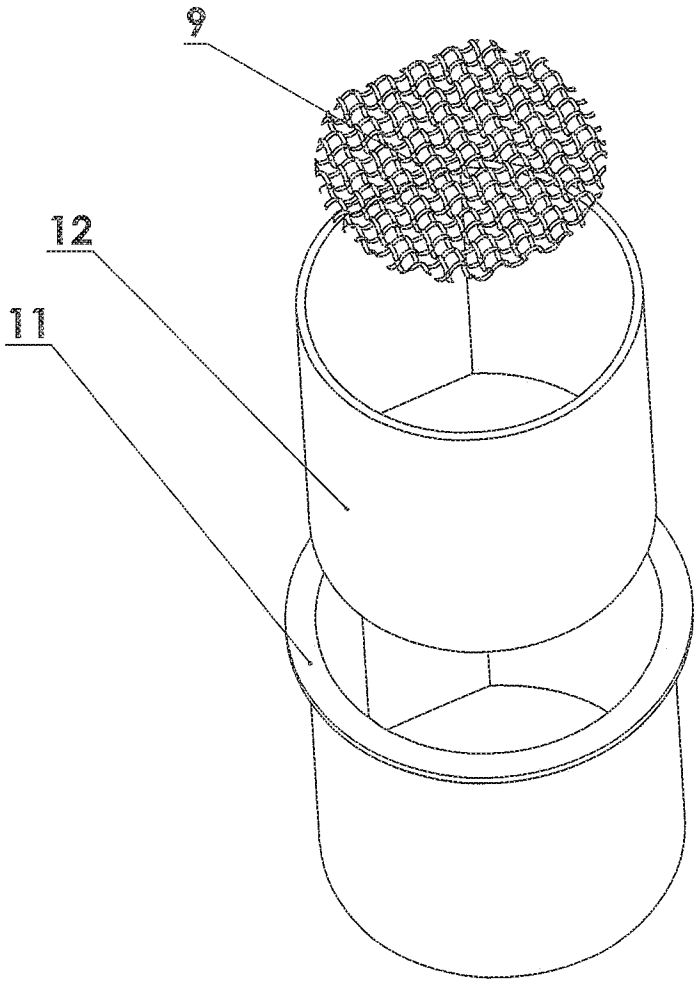
FIG. 10B is an exploded view of the fifth embodiment of the present invention illustrated in FIG. 10A.
Figure 10A:
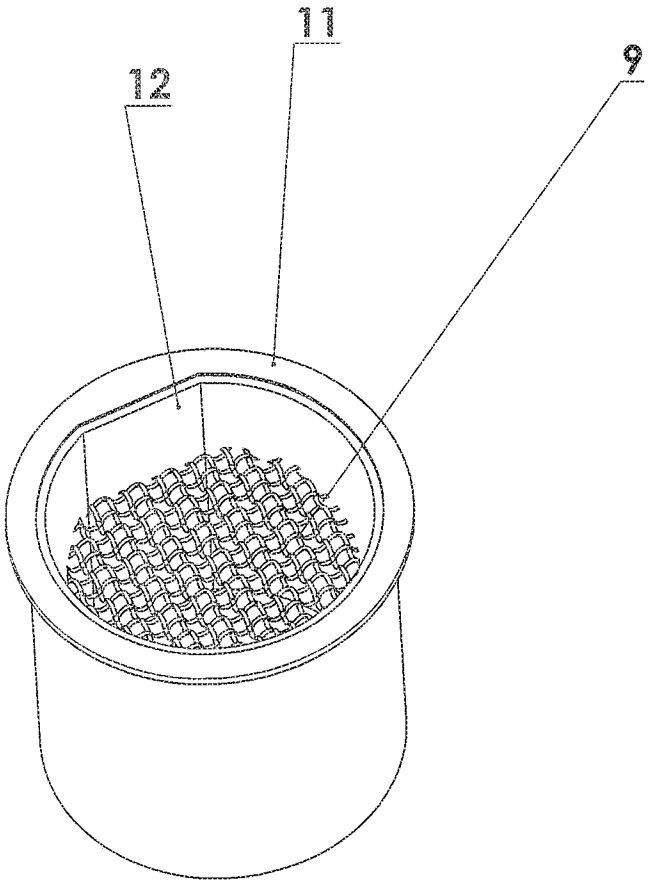
FIG. 10A shows perspective view of a fifth embodiment of the present invention similar to the second embodiment illustrated in FIG. SA wherein the floatation ring is eliminated.

Referring to FIGS. 10A and 10B, the embodiment illustrated is similar to the embodiment illustrated in FIGS. SA and SB. The target workpiece (9) is removably inserted within product container (12), which is removably inserted within induction receptacle (11). The components of this embodiment are similar to those shown in FIGS. SA and SB with the exception that the target workpiece does not include a floatation ring. The target workpiece (9) comprises geometry to nest within the product container (12), which comprises geometry to nest within the induction receptacle (11). In this variant, the assembly is comprised of an asymmetrical geometry about a medial plane to prevent the rotation of the target workpiece when stirred or agitated. The product container is between 2 and S inches (S.08 and 12.7 cm) deep requiring use of coils along the sides of the induction receptacle. In particular, the cross-section of each component has at least one flat side surface for aligning the components in assembled position and preventing rotation while collecting the product onto the applicator. Although this embodiment is shown to have flat side surfaces, the cross-sectional configuration of each component could be of any geometric shape to align and prevent rotation of the components during use.

Figure 11B:
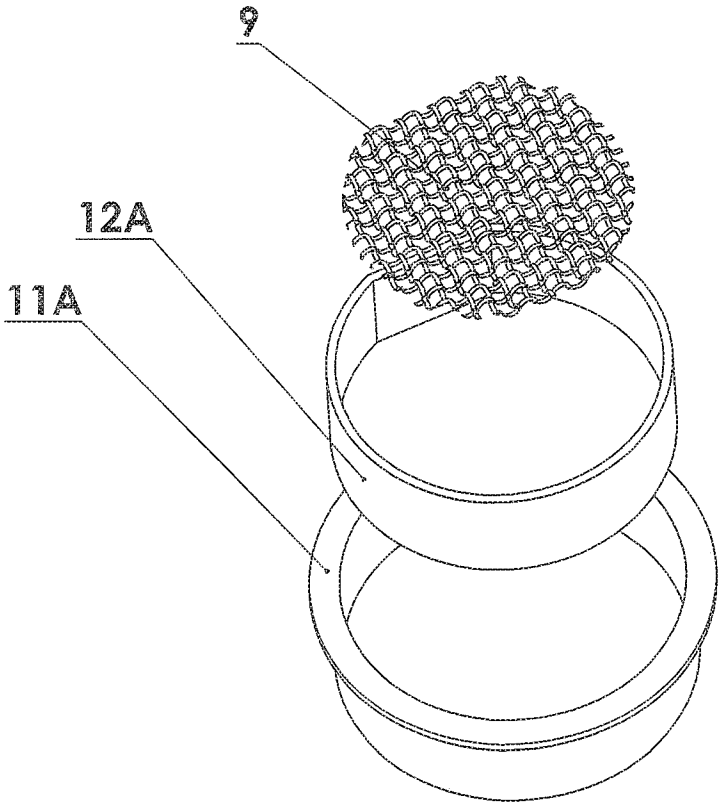
FIG. 11B is an exploded view of sixth embodiment of FIG. 11A.
Figure 11A:
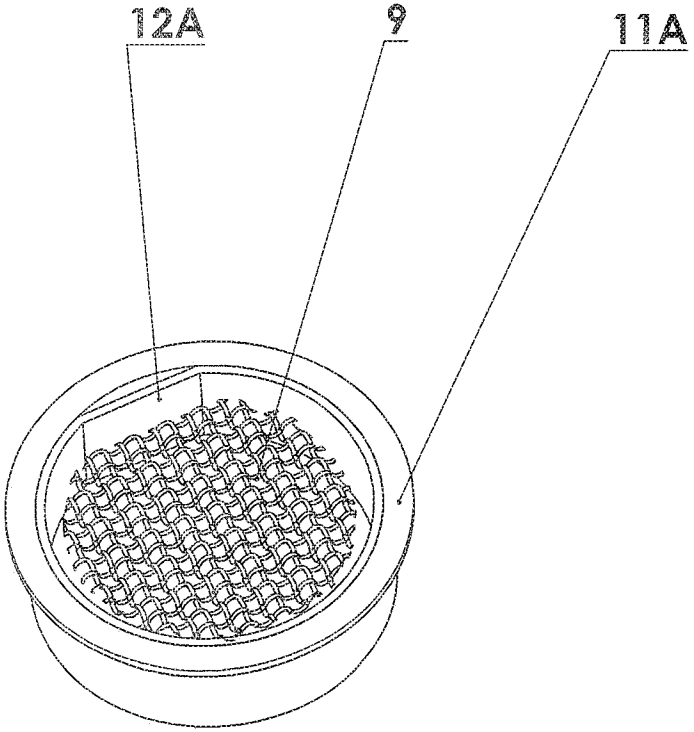
FIG. 11A shows a perspective view of a sixth embodiment of an induction receptacle, product container and target workpiece usable with the fourth embodiment illustrated in FIG. 9.

Referring to FIGS. 11A and 11B, the alternative embodiment illustrated includes a target workpiece (9) illustrated as an electrically conductive metallic screen removably inserted within product container (12A), which is removably inserted within induction receptacle (11A). This embodiment is to be used with the pancake coil in the embodiment illustrated in FIG. 9. The components of this embodiment are similar to those shown in FIGS. SA, SB, 10A and 10B with the exception that the target workpiece does not include floatation ring and the overall depth of the induction receptacle and product container is less. In this embodiment, the product container (12A) is between 0.500 and 2 inches (1.27 and S.08 cm) deep requiring use of the pancake coil along the bottom of the induction receptacle. This provides opportunity for the user to introduce product as needed into the product container or to have a greatly reduced starting sample size. As in the previous embodiments, the cross-section of each component has at least one flat side surface for aligning the components in assembled position and preventing rotation of the target workpiece while collecting the product onto the applicator, and the cross-sectional configuration of each component could be of any geometric shape to align and prevent rotation of the components during use.

Referring to FIGS. 12-19, alternative to the electrically conductive screen type target workpiece illustrated in the embodiments described above, other embodiments of target workpieces are shown that can be employed in each of the embodiments described supra. Applicants have discovered that by varying the construction of the target workpiece, the heating pattern on the target workpiece can be modified. Each target workpiece illustrated in FIGS. 12-19 comprises a solid metallic disc target workpiece having an outer peripheral surface (51), an upper surface (52) and a lower surface (53). The peripheral surface (51) is where heat originates due to the concentration of flux lines from a cylindrical coil such as seen in FIGS. 2 and 8. The upper surface (52) provides the surface area that that the user will interface with. The lower surface (53) is the area or region that first provides heat to the product.

As illustrated in FIGS. 12 and 12A, target workpiece (30) comprises a solid metallic disc target workpiece having an outer peripheral surface (51), an upper surface (52) and a lower surface (53). A plurality of evenly distributed holes or apertures (37) extend therethrough and are located in spaced relation between the outer peripheral surface (51). In the preferred embodiment, six holes or apertures (37) are circular and have a diameter ranging between 0.030 to 1.000 inches (0.076 to 2.54 cm), most preferably between 0.030 and 0.400 inches (0.076 and 1.016 cm). In this embodiment, heat is propagated from the outer peripheral surface towards the center axis of the target workpiece. As the target workpiece is energized by electromagnetic field from the induction coil, the heat generated in the target workpiece (30) is focused in the peripheral region indicated by the cross-hatching (36).

Referring to FIG. 13, target workpiece (39) composes a solid metallic disc with peripheral, upper and lower surfaces (not numbered). In this embodiment, the target workpiece includes through-passages comprised of four radially extending slots (40) dividing the disc into four separate quadrants (42) having slots (41) each connected by a central section (43). Each quadrant includes a centrally disposed slot (41) having sharp and/or rounded corners. This embodiment provides an increased rate of heat transfer within the conductive material from the heat region (44) to the center of the target workpiece due to the absence of material and also by the outer slots (40) that direct the eddy current along the peripheral surface towards the center. The slots (40) and (41) extend entirely through the disc from the upper surface to the lower surface. In this embodiment, as the target workpiece is energized by electromagnetic flux from the induction coil, the heat generated in the target workpiece (39) is focused in the areas indicated by the cross-hatching (44).

Figure 14:
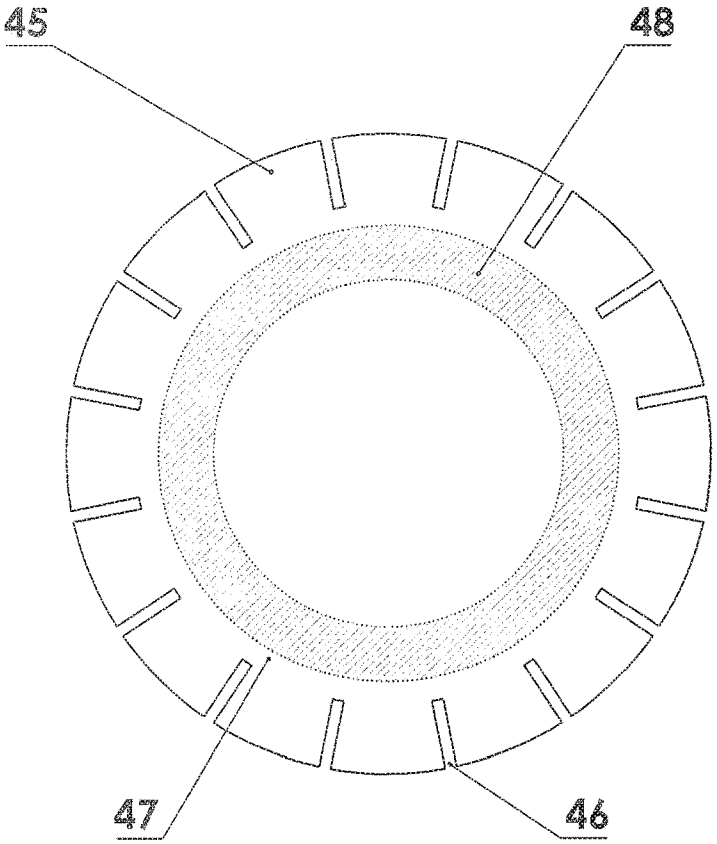

Referring to FIG. 14, target workpiece (45) composes a solid metallic disc with peripheral, upper and lower surfaces (not numbered). In this embodiment, the target workpiece includes through-passages comprised of radially extending square-shaped slots (46) spaced equidistant from each other. Each slot extends inwardly from the peripheral surface to a point in the peripheral region (47) of the disc. These square slots are comprised of only straight walls and 90-degree angles to propagate the heat zone (48) inward from the periphery of the target workpiece. This assists in more even heat distribution through the target workpiece.

Figure 15:
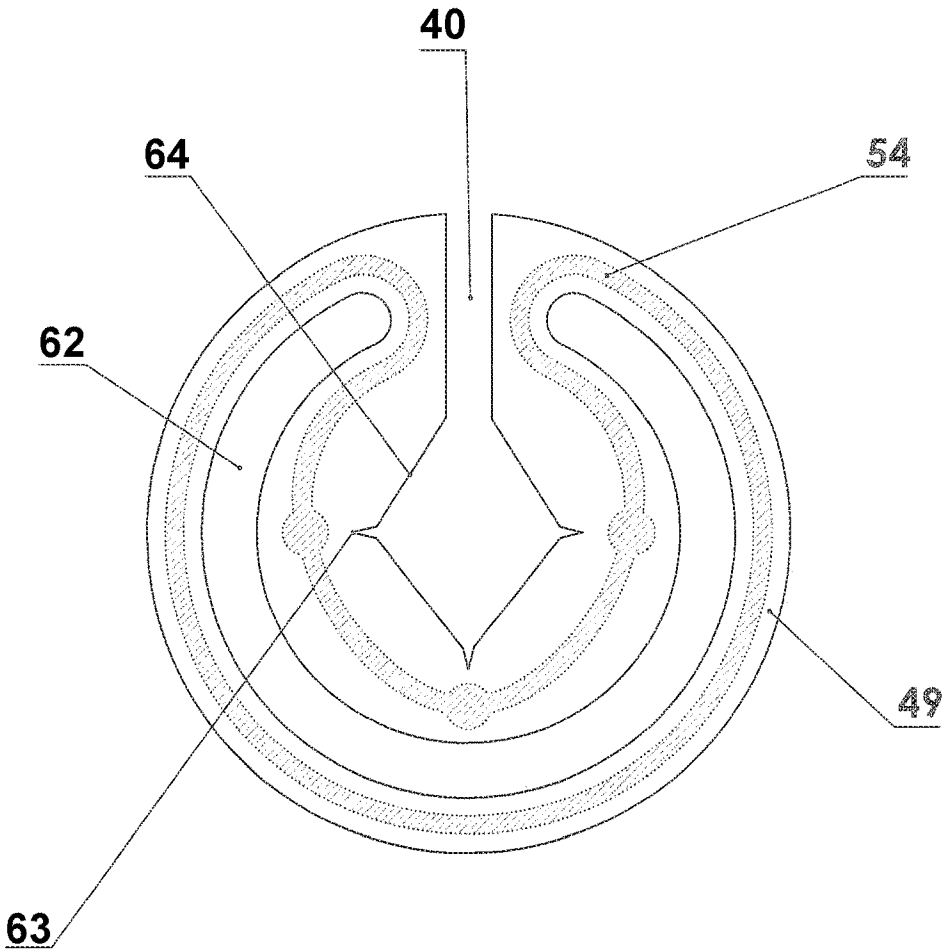

Referring to FIG. 15, target workpiece (49) comprises a solid metallic disc with peripheral, upper and lower surfaces (not numbered). This embodiment includes through-passages comprised of a radially extending slot (40) and crescent-shaped slot (62). Slot (50) extends from the peripheral surface to one corner of a central diamond-shaped cutout (64). Except for the corner where the slot (50) enters the diamond-shaped cutout, the remaining corners are formed with pronounced peaks (63). Crescent-shaped slot (62) surrounds the slot (40) and diamond-shaped cutout (64). The slots (40) and (62) and diamond-shaped cutout (64) extend entirely through the disc from the upper surface to the lower surface. The remainder of the disc is solid. In this embodiment, as the target workpiece is energized by electromagnetic flux from the induction coil, the heat generated in the target workpiece (49) is focused in the indicated regions (54).

Figure 17:
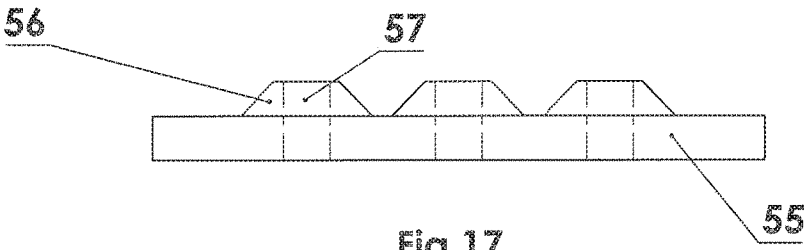
Figure 16:
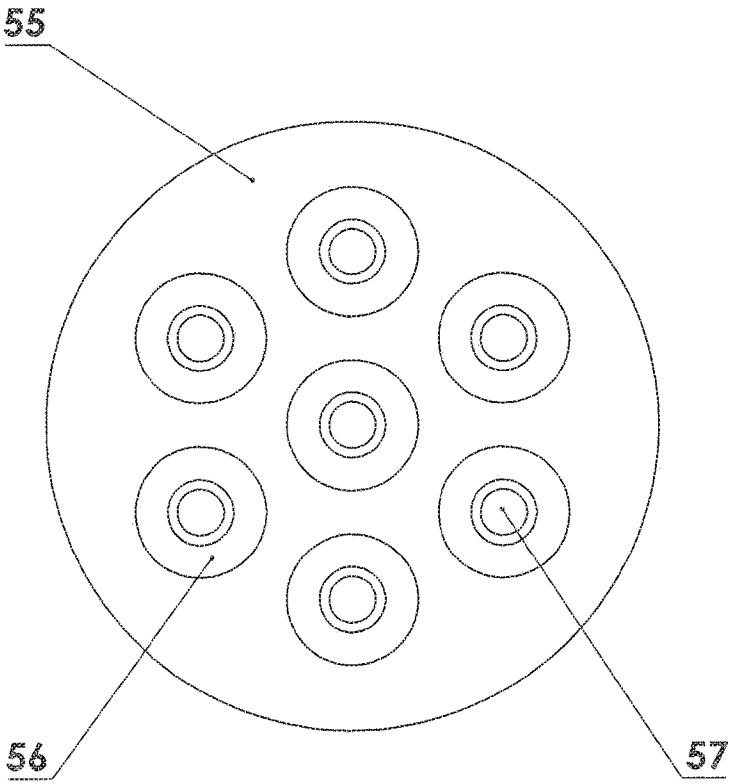

Referring to FIGS. 16 and 17, target workpiece (55) comprises a solid metallic disc with peripheral, upper and lower surfaces (not numbered). In this embodiment, the target workpiece (55) is similar to the target workpiece illustrated in FIG. 12 and therefore, would have the very similar heat distribution. However, this embodiment differs from that of FIG. 12 in that each hole (57) is surrounded by an upstanding conical target workpiece (56). The upstanding conical target workpieces facilitate agitation and lathering of the melted product as it flows through holes or through-passages (57) and collected by the user such as by a shaving brush. Each conical target workpiece extends between 0.010 and 0.250 inches (0.0254 and 0.635 cm) from the upper surface of the target workpiece. Each hole (57) may be between 0.020 and 0.750 inches (0.05 and 1.9 cm) in diameter. In this embodiment, although no cross-hatching is shown, as the target workpiece is energized by electromagnetic flux from the induction coil, the heat generated in the target workpiece (55) is focused in the same region indicated by the cross-hatching (36) in FIG. 12.

Figure 19:
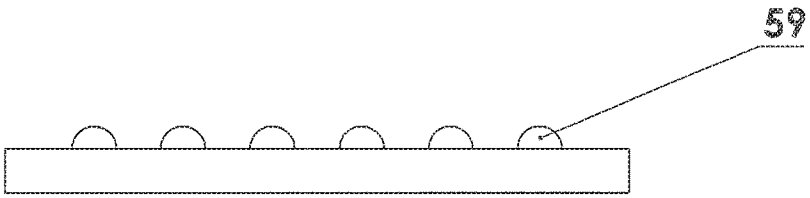
Figure 18:
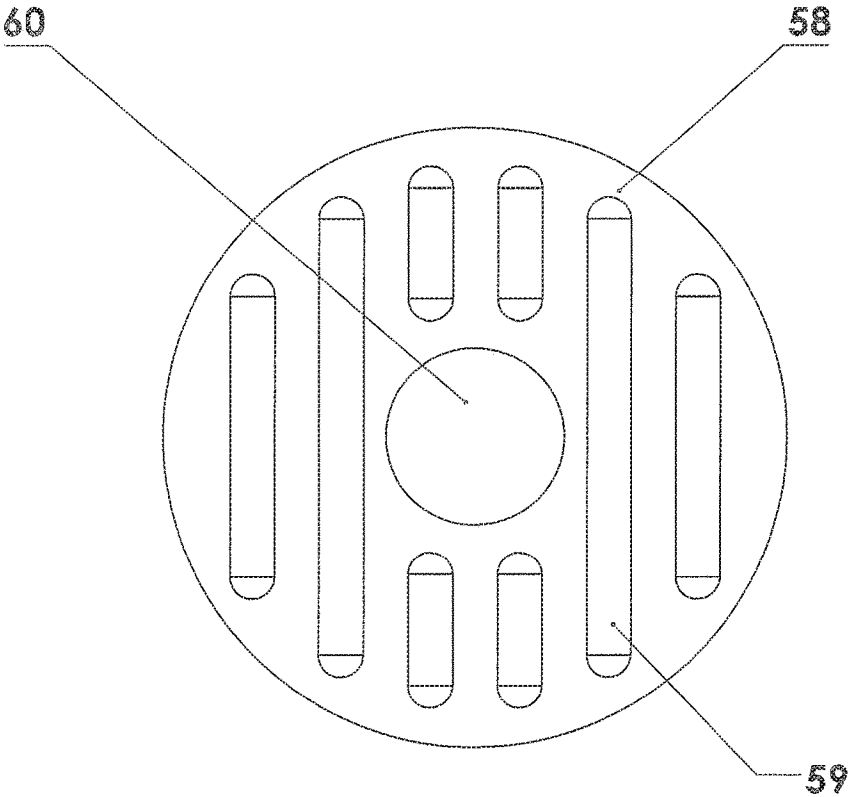

Referring to FIGS. 18 and 19, target workpiece (58) comprises a solid metallic disc with peripheral, upper and lower surfaces (not numbered). In this embodiment, the target workpiece (58) includes a through-passage comprised of a single central large hole (60) extending therethrough from the upper surface to the lower surface. A plurality of upstanding ribs (59) are evenly disposed on the upper surface. The upstanding ribs provide agitation to the melted product as it flows through hole (60) to create lather when the melted product is collected by the user such as by a shaving brush. In this embodiment, although no cross-hatching is shown, as the target workpiece is energized by electromagnetic flux from the induction coil, the heat generated in the target workpiece (58) is evenly focused about each of the upstanding ribs (59).

Figure 20:
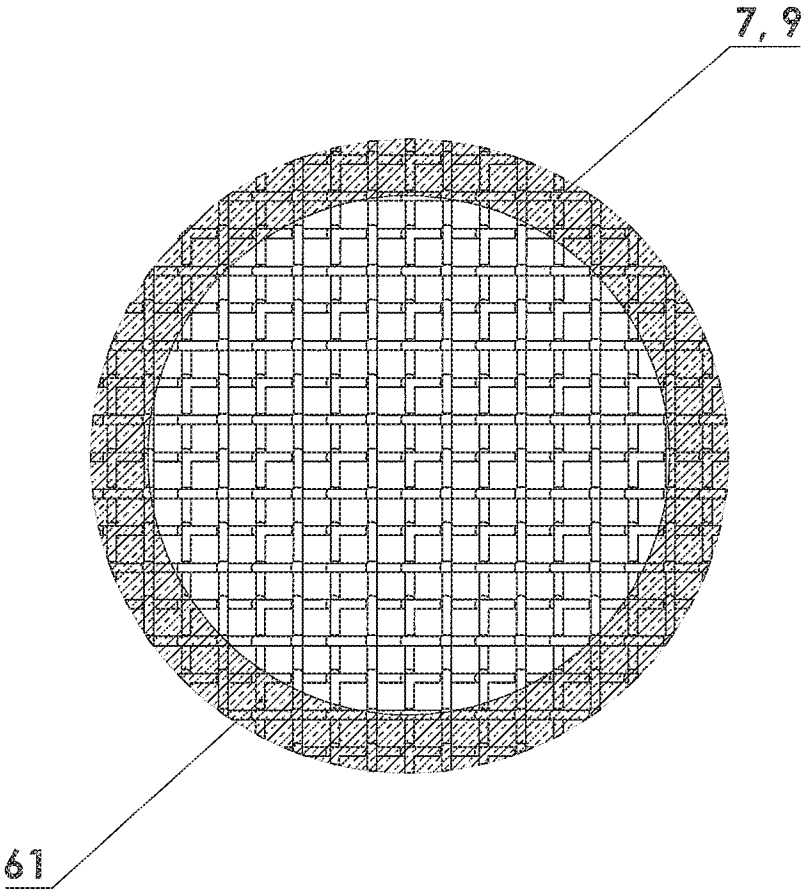

Referring to FIG. 20, the target workpiece illustrated is the conductive metallic screen (7 or 9) shown in the embodiments of FIGS. 1 and 8-11. The screen is comprised of woven strands of electrically conductive material, preferably aluminum or stainless steel. The woven strands are between 0.010 and 0.070 inches (0.0254 and 1.778 cm) in diameter with an open area between 20 and 85 percent of the whole area. The interstices between the woven strands constitute through-passages for heated and/or melted product to flow through the target workpiece. The heat zone (61) propagates from four outer peripheral regions towards the center. These four outer peripheral regions are located at the points on the peripheral surface where the longest strands intersect the peripheral surface. The contact points of the strands are preferably joined to facilitate even distribution of the heat zone. The varying topology of the top surface of this embodiment provides the user with an area that is highly advantageous for creating lather. In this embodiment, as the target workpiece is energized by electromagnetic flux from the induction coil, the heat generated in the target workpiece is focused about its peripheral region as indicated by the cross-hatched area (61).

Although only indicated in FIG. 12A, all the target workpieces illustrated in FIGS. 12-19 have a material thickness (h) ranging between 0.005 and 0.150 inches (0.0127 and 0.0381 cm), most preferably between 0.008 and 0.020 inches (0.020 and 0.050 cm), and a width (w) ranging between 2 and 4 inches (5.08 cm and 10.16 cm). The various target workpiece configurations illustrated in FIGS. 12-19 provide differing heating characteristics by changing or interrupting the peripheral surface (51) profile, or target workpiece surface that is parallel to the cylindrical coil wall, of the target workpiece. Depending on the application and heating requirement, some target workpieces have more total surface area to provide more contact with the product, and thus faster heating of the product. The varying upper surface (52) topography of each target workpiece in conjunction with the viscosity of the product may significantly impact the rate at which the target workpiece descends though the product. Additionally, the varying top surface topography provides opportunity for aeration. For applications requiring agitation or aeration the top surface topography of the target workpiece possess more variance. The size and number of openings are also advantageous in providing agitation of the product for applications requiring lather, such as shaving soaps. The present invention may simultaneously utilize one or more target workpieces composed of any of the following types of steel alloy, carbon, tool, or stainless and may be of the ferritic, martensitic, and/or austenitic grain structure. Additionally, and preferably, the target workpiece may be of any of the SAE designated aluminum types. Aluminum, generally non-compatible with household induction heaters/cookers, provides corrosion resistance, a very low heat capacity, and high thermal conductivity as compared to other materials that work with household induction cooking/warming systems. The low heat capacity of the aluminum allows the target workpiece to raise temperature quickly and also to cool quickly once the cycle has ended. This in turn allows the product to return to its original state more quickly than would one of the steel grades that retains more heat. A target workpiece comprised of a material with a high heat capacity would descend downward towards the bottom of the product container even after necessitating use due to the excess heat held within the conductive material. The high thermal conductivity of the aluminum target workpiece is advantageous in transferring the heat generated by the eddy current to the product as quickly as possible. As a result of the high thermal conductivity and low heat capacity, the energy from the electromagnet field is instantaneously transferred to the product, in the form of heat, with minimal dwell time in the target workpiece.

Figure 21:
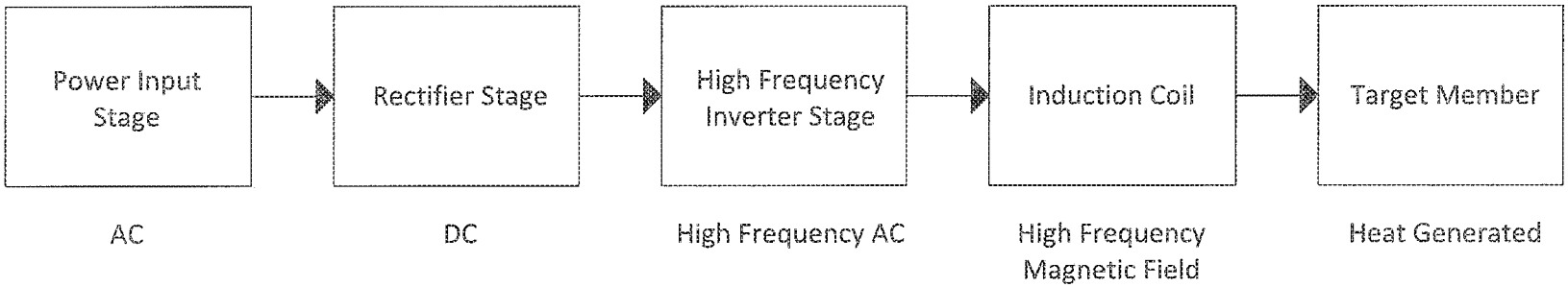
FIG. 21 shows a high level flowchart demonstrating the process by which the input power is transferred to the target workpiece.

The block diagram illustrated in FIG. 21 shows the process for transferring power from its origin to heat energy within the target workpiece. As illustrated in FIG. 6, the Power Input Stage is in the form of alternating current as commonly sourced by the wall outlet in residential and/or commercial buildings. This alternating current passes into a rectifier stage whereby it is converted to direct current. This stage is not intended to be limiting but rather showing one suitable option. For example, the transformer and rectifier may be incorporated into the microprocessor unit. In other embodiments the AC line may be eliminated and replaced with a battery. The direct current is then converted back to a high frequency alternating current by any common oscillator circuit whether digital or analog. The high frequency alternating current then creates an electromagnetic field that generates eddy current within the target workpiece and thus creating heat.

Figure 22:
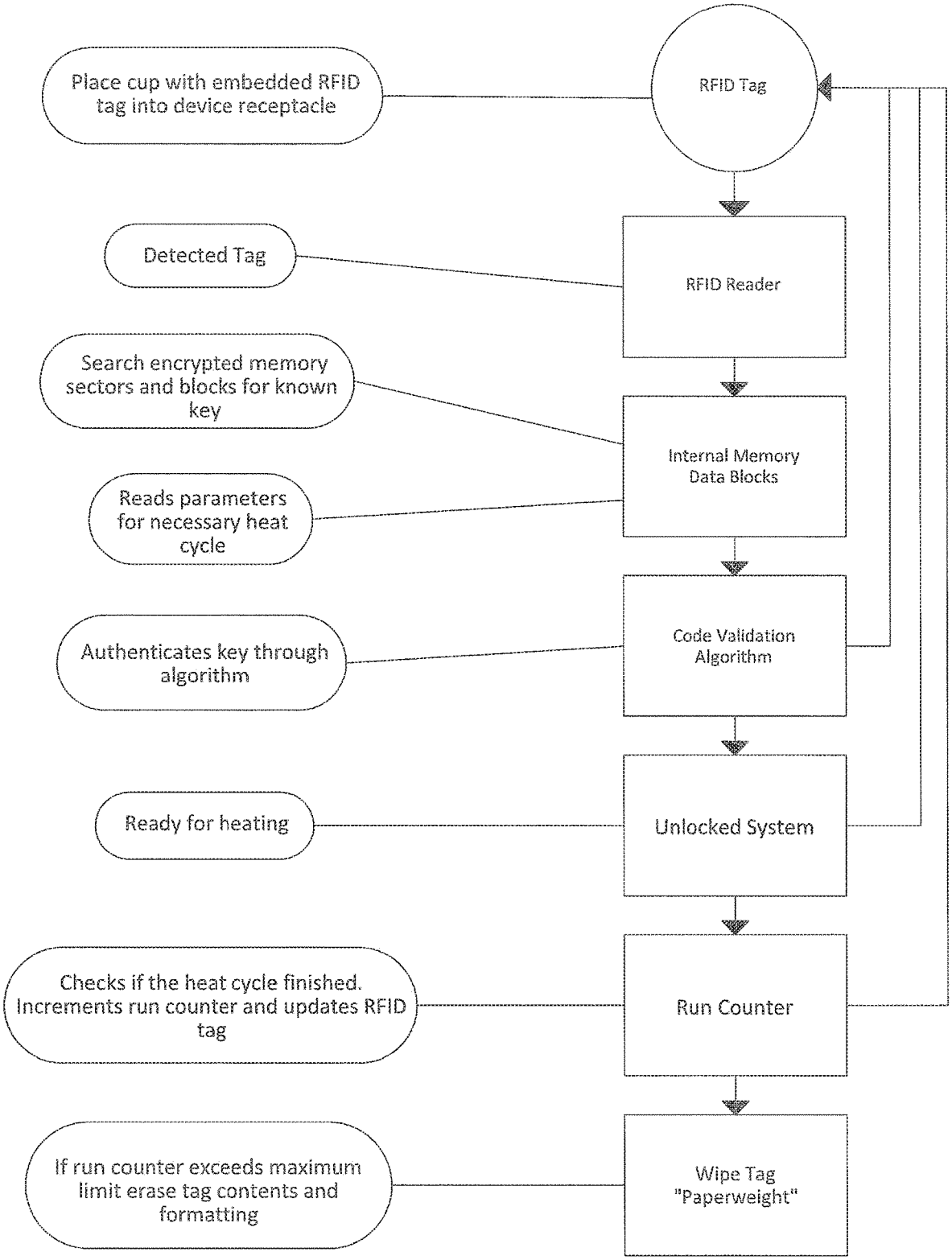
FIG. 22 shows a flowchart of the decision making process of the present invention.

The diagram in FIG. 22 shows a decision making process related to the RFID system. A unique RFID tag (14) is attached to each product container and has been pre-programmed with information used by the present invention for optimizing the induction heating cycle for the given product. After detection, the RFID reader reads the information on the RFID tag found on the internal memory blocks within the RFID tag and provides that information to the microprocessor. This information includes product type, heat cycle duration, heat level required, and induction values needed for optimization of the induction cycle, such as frequency. The system then runs the validation algorithm to determine that the RFID tag is a valid tag. This step is incorporated as a safety measure. After completing these steps, the system unlocks the system and alerts the user that the heat cycle may activated. After a given number of cycles has been run the RFID tag associated with the product container is modified by the induction system microcontroller to provide information such as number of cycle run, duration of cycles, date, and/or other information related to product usage. Additionally, the system may render the RFID tag incapacitated for future use.

Operation of the induction heating system of the present invention is as follows. AC power supply (13) is connected to the system. Voltage received is then electromagnetically reduced by transformer (15) and converted into direct current (DC) waveform by rectifier (16). Transformer (15) and rectifier (16) may be packaged together externally in an AC to DC power supply commonly used by computers or electronic devices. Inside the device the rectified DC power is passed through DC regulator (17), a monolithic integrated circuit regulator that steps down the voltage to TTL, CMOS, ECL levels etc. The induction heater coil (3) is controlled by the microprocessor (19), which also controls the timing and frequency of the HF inverter (25), sensors (20), (21), operator interface (18), led lights (34), timers, antenna (22), speaker (23) and RFID reader (27). The microprocessor (19) may also be used to interact with many other device peripherals if needed. The microprocessor is programmed to control and vary the oscillation frequency in order to reach electromagnetic resonance between the target workpiece and the resonant tank. The microprocessor has flash memory read-while-write capabilities and EEPROM storage used in order to store user settings, timers, and safeties. Users are able to interact with the device by visually watching or pressing the operator interface (18) or user pushbuttons (29). Display of operator interface (18) is constructed of a piezoresistive, capacitive, surface acoustic, infrared grid or similar technologies. It allows the user to press and start a heating cycle while displaying helpful information based on the temperature or duration of the cycle. Safety information can be depicted on this display or any other helpful visual aids. In addition to operator interface (18), a speaker (23) is used to provide audible feedback and alerts to the user based on the state of the heat cycle. The pushbuttons (29) are used as a secondary source of user input. Nearby LEDs (34) are used to provide a secondary visual indication of the state of the device. Pushbuttons, LEDs, and the Operator Interface may be reprogrammed by the manufacturer in order to adjust the functionality and usability throughout different device revisions. Once a heat cycle is initiated, the microprocessor (19) inputs a low voltage pulse width modulated (PWM) signal received by the high frequency (HF) inverter module (25). The inverter module switches the rectified DC power from rectifier (16) to HF alternating current power at the oscillation frequency set by the microprocessor (19). High frequency AC power is then passed into a series or parallel resonant RLC tank. The tanks capacitance, inductance, and resistance are optimized to reach the resonant frequency of the PWM signal. This resonance also matches the oscillation frequency of the target workpieces illustrated in FIGS. 12-20. Throughout the heat cycle, current transferred into each target workpiece is measured by sensor (21). At this time, microprocessor (19) adjusts the oscillation frequency in order to transfer maximum power into the target workpieces. If the current exceeds a safety limit measured by sensor (21), the device shuts off the heat cycle. Likewise, the temperature of the internal components is measured by sensor (20). This prevents the device from being left on throughout the day or operating in harsh environments. Sensor (20) also measures the induction coil (3) temperature to prevent overheating on its internal windings. During the heat cycle high frequency currents are passed through the resonant tank (26) and into the coil (3, 3A or 3B) disposed adjacent the induction receptacle (4, 4A or 11) that receives the product container (6, 6A or 12). The high frequency currents are then transferred to the target workpiece through means of electromagnetic induction. Eddy currents are generated inside the target workpiece and cause a Joule heating effect as well as a heating through magnetic hysteresis. Heat generated through the target workpiece then permeates through to the top layer of the product inside the container. Due to the geometry of the target workpiece, energy is transferred more directly to the "heat affected product zone" of the product inside product container (6, 6A or 12).

Figure 23:
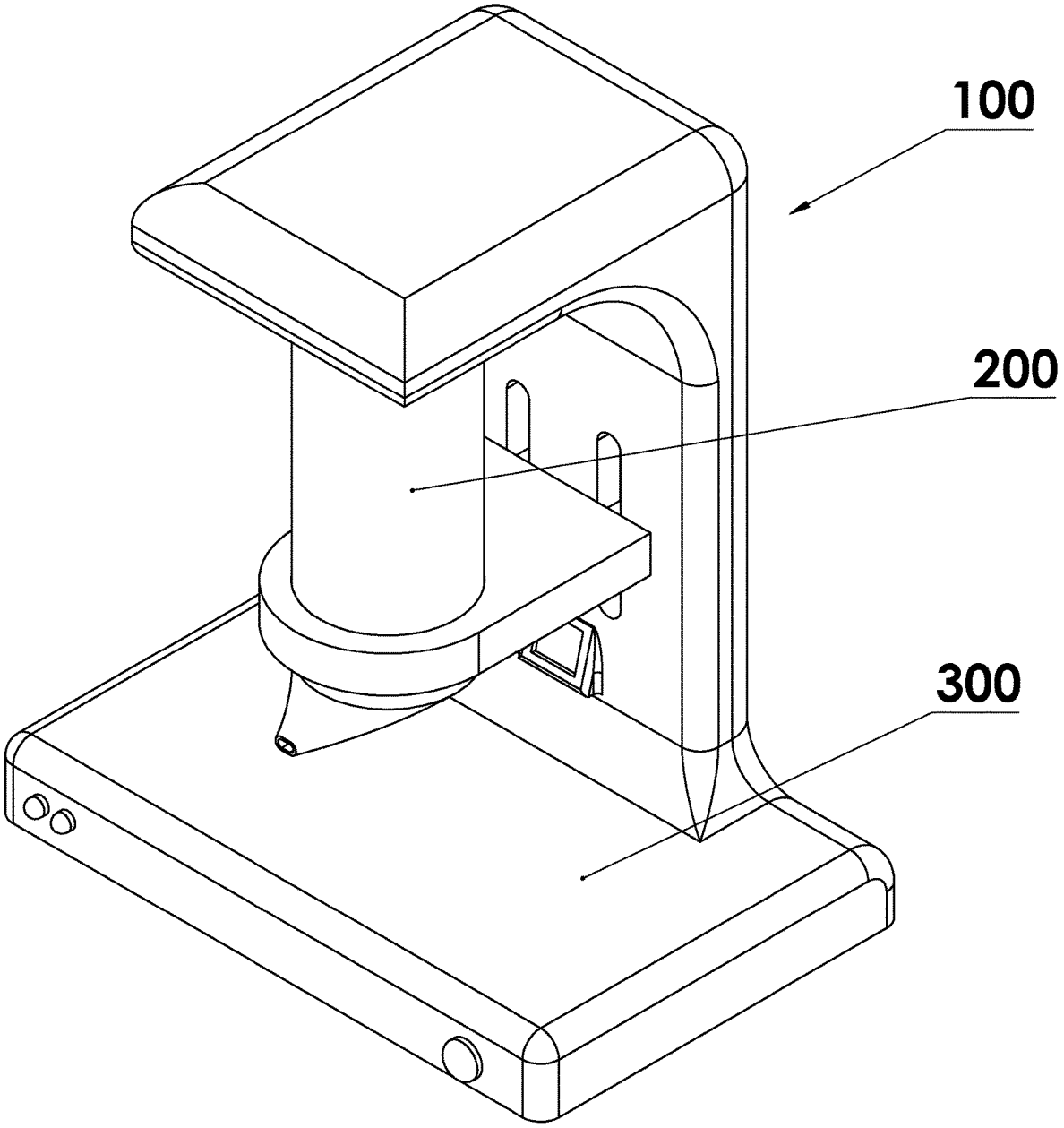
FIG. 23 is a front isometric view of an alternative embodiment of the invention including the dispenser housing and the material container.

Another embodiment of the present invention relates to a dispenser using inductive heat to heat certain volumes of material upon dispensing. As illustrated in FIG. 23, the dispensing system (100) comprises a product container (200) and dispenser (300). The product container (200) is generally locked in the dispenser when in use as described herein.

Figure 24:
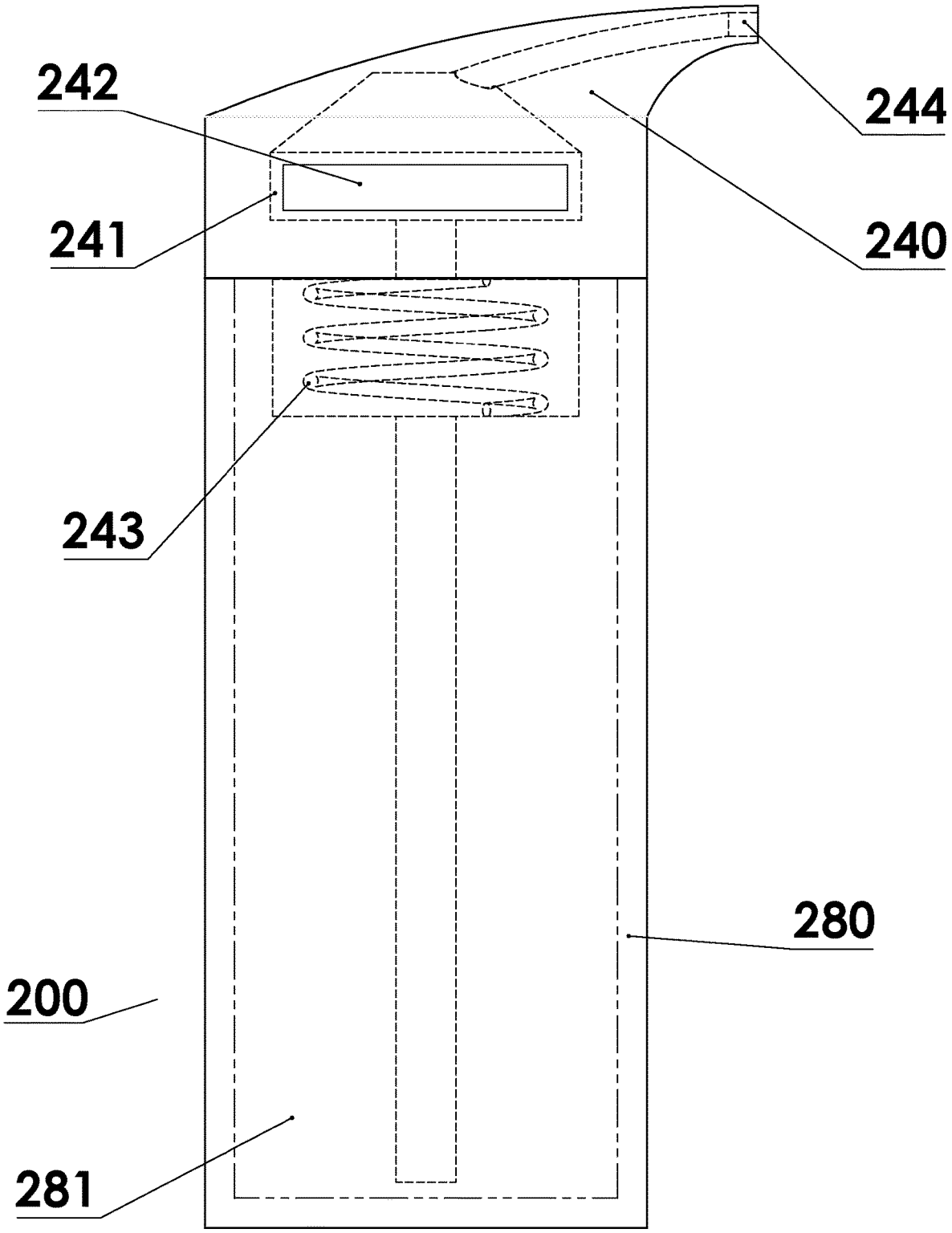
FIG. 24 is a cross-sectional view of the material container.

As illustrated in FIG. 24, this cross-sectional view shows the material container (200). Any variety of pumping mechanism (243) may be used to expel material (281) from the product container (200). In a preferred embodiment, aspects of the product container (200) are compressible by external means thus providing a diaphragm (520) and check valve (510) internal to the product container (200).

Figure 29:
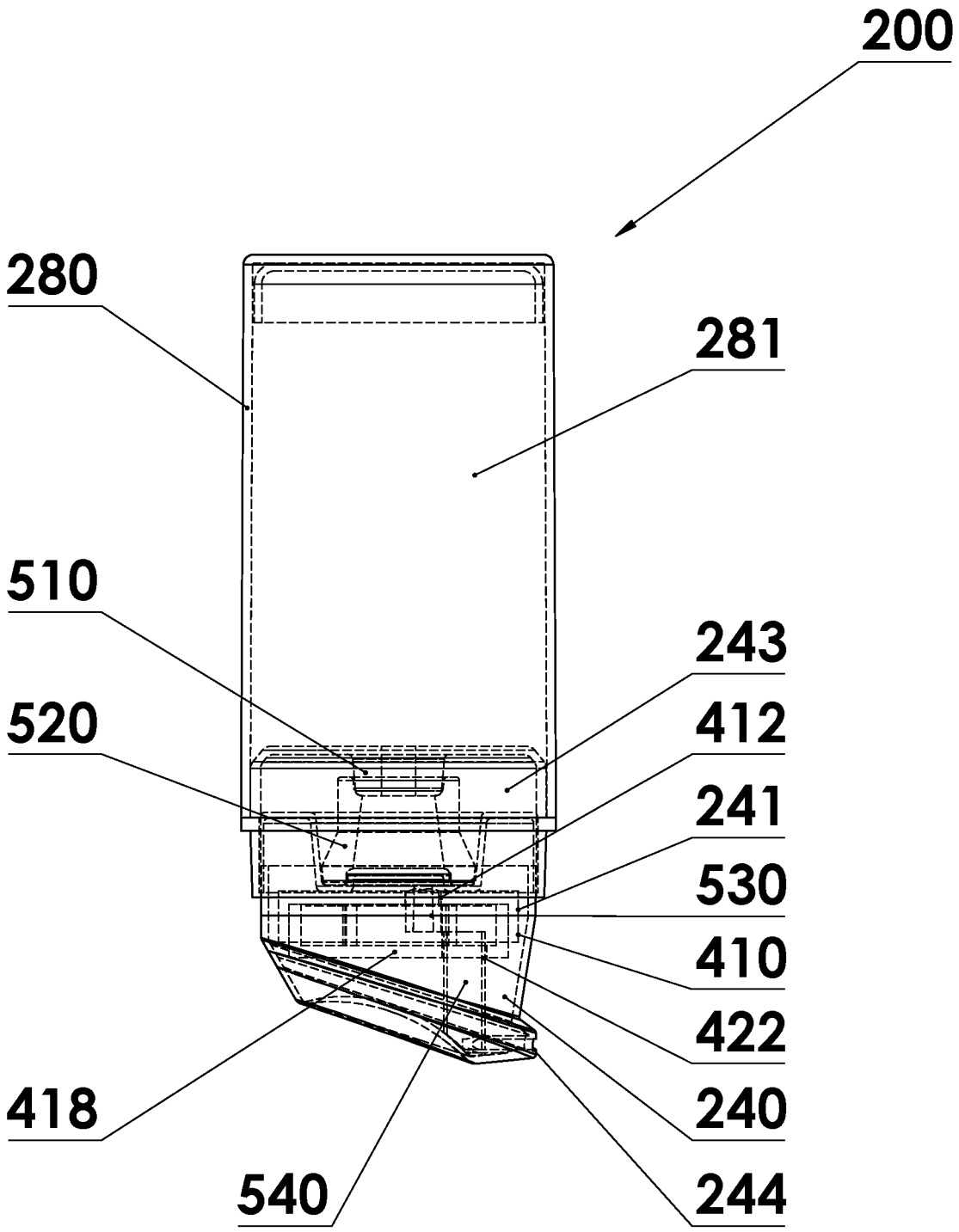
FIG. 29 is a cross-sectional view of another embodiment of the material container.

Further detail of the diaphragm and check valve are shown in FIG. 29. This allows the material to be delivered either manually or by the dispenser. In either instance, an external force is required to expel the material (281) from the product container (200). The product container (200) comprises a material reservoir (280) and a material heat exchanger cavity (240). The material heat exchanger cavity (240) houses an induction cavity (241) which houses a target workpiece (242). The target workpiece (242) is preferably any conductive material but for application in corrosive environments is preferably aluminum or stainless steel or any other type of conductive material which may or may not be coated with a thin layer of plastic to prevent accumulation of material (281) or oxidation on the target workpiece (242). In a preferred embodiment, the product container (200) further comprises an outlet (244) from where the heated material (281) is dispensed.

Figure 25:
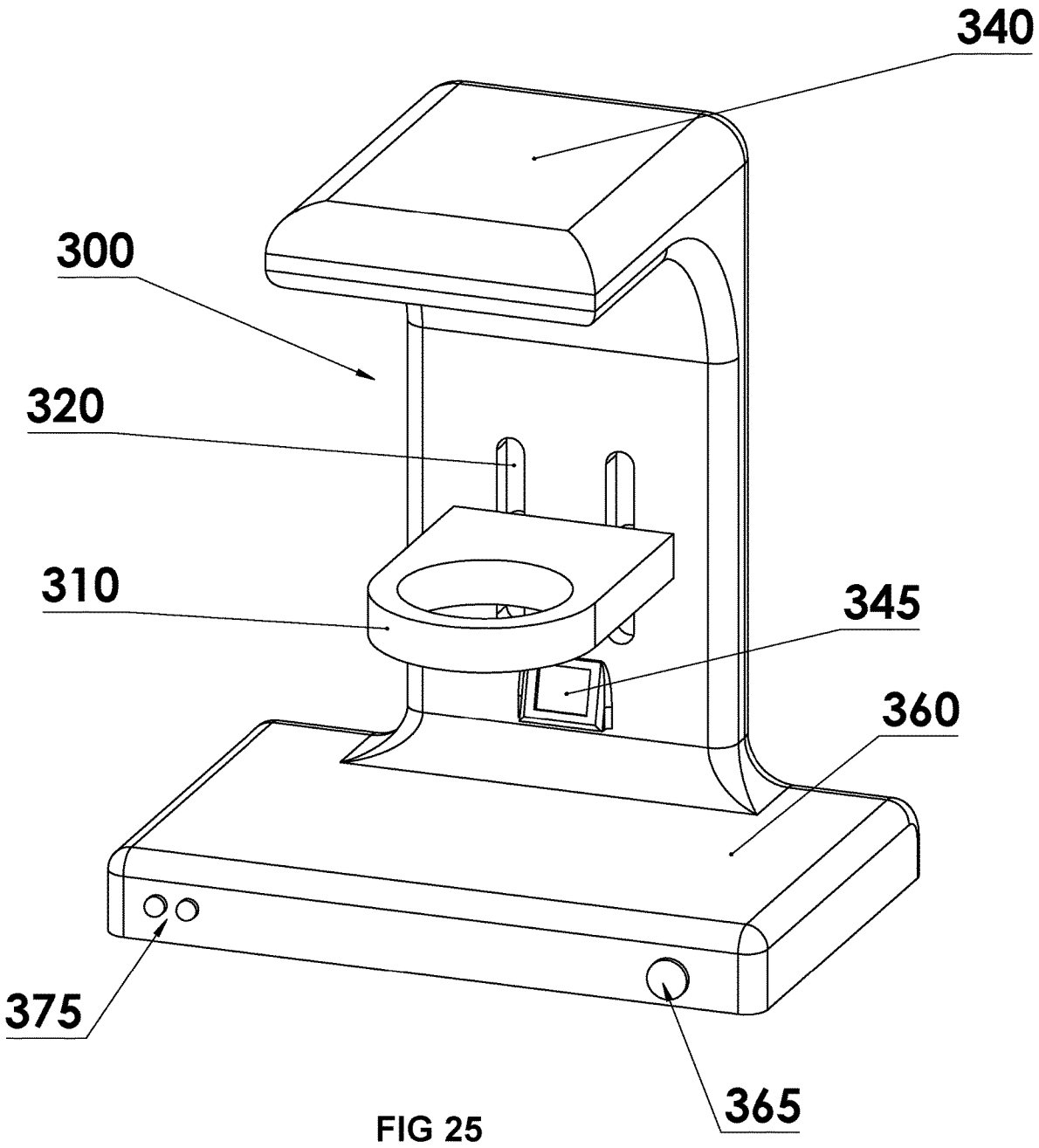
FIG. 25 is a front isometric view of the dispenser housing.

As illustrated in FIG. 25, the dispenser (300) comprises an induction coil housing (310) and a cover (340), among other barriers, to assist in retaining the product container (200) when in the proper position. In one embodiment, the induction coil housing (310) houses an induction coil but is also mechanically coupled to a vertical movement system (320) that allows for vertical movement so as to accommodate different size product containers (200) or product containers (200) having different types of pumping mechanisms (243). Additionally, the vertical movement system (320) allows compression of the product container (200) when the product container (200) requires physical compression to dispense the material (281) within. The vertical movement system (320) can be any type of mechanical system which would allow for the vertical movement required for compression or height changes. When the dispensing system (100) receives a signal by pressing the control button (365) to begin the induction heating cycle, an electromagnetic field is produced within the induction coil housing (310). The electromagnetic field generates an eddy current within the target workpiece (242) thereby creating heat. Preferably, the circuitry used to generate the current is located within the lower dispenser housing (360). LED lights (375) may be used to communicate heating cycle status to the user. The dispenser (300) may also use a motion sensor (345) to provide feedback as to when the heating and/or dispensing cycle should begin or end. Within the cover (340) lies an RFID reader or similar technology for communicating with a RFID tag located on the product container (200) in such a location that it would be in close proximity to the RFID reader. An important feature of the invention is the relationship between the target workpiece and the RFID tag. Information contained therein can be read and/or recorded to the RFID tag which itself is associated with each product container (200) so as to provide unique instructions to the dispenser (300) regarding heating and dispensing.

In one embodiment, the RFID tag provides identification of the resonant frequency of the target workpiece (242). An onboard ammeter housed in the dispenser (300) (not pictured) measures current to confirm that the expected current matches the measured current.

In another embodiment, the target workpiece (242) is comprised of a device that changes resistance with temperature. As the resistance changes, due to the temperature change, the inductance of the coil changes thereby moving the resonant frequency. The resultant resonant frequency change creates less heat within the target workpiece. This relationship, between frequency, temperature, and current drawn, is calibrated into the induction dispenser via the RFID tag. In other words, the induction heating circuit provides a fixed frequency for generation of an electromagnetic field. As the target workpiece (242) increases in temperature the resistance changing device moves the target workpiece (242) further from resonance which reduces the heat generated within the target workpiece, thus maintaining the temperature of the target workpiece. A form of redundancy is programmed into the system by a third measurement, current. The current draw of the coil is measured and should be within a given range for a given target workpiece at a given temperature. All such data and calibration criteria are provided by the RFID tag.

An electromagnetic field based on preset values determined by the RFID tag can be created such that, with the oscillation frequency fixed, heat is generated within the target workpiece. As the temperature of the target workpiece increases the resistance changing device increases in resistances thus moving the inductance of the coil thereby changing the resonant tank frequency. Because the frequency is fixed the current would change, either up or down depending on the corresponding resonance vs. current curve. The induction system of said present invention takes measurements of current and coil inductance to determine the temperature of the target workpiece. Depending on RFID instructions and/or user input to the controls of the induction system the induction system may make adjustments to either increase or decrease the temperature of the target workpiece. Thus, the induction system becomes a closed loop system in which measurements are taken to verify and maintain system functions.

Figure 26:
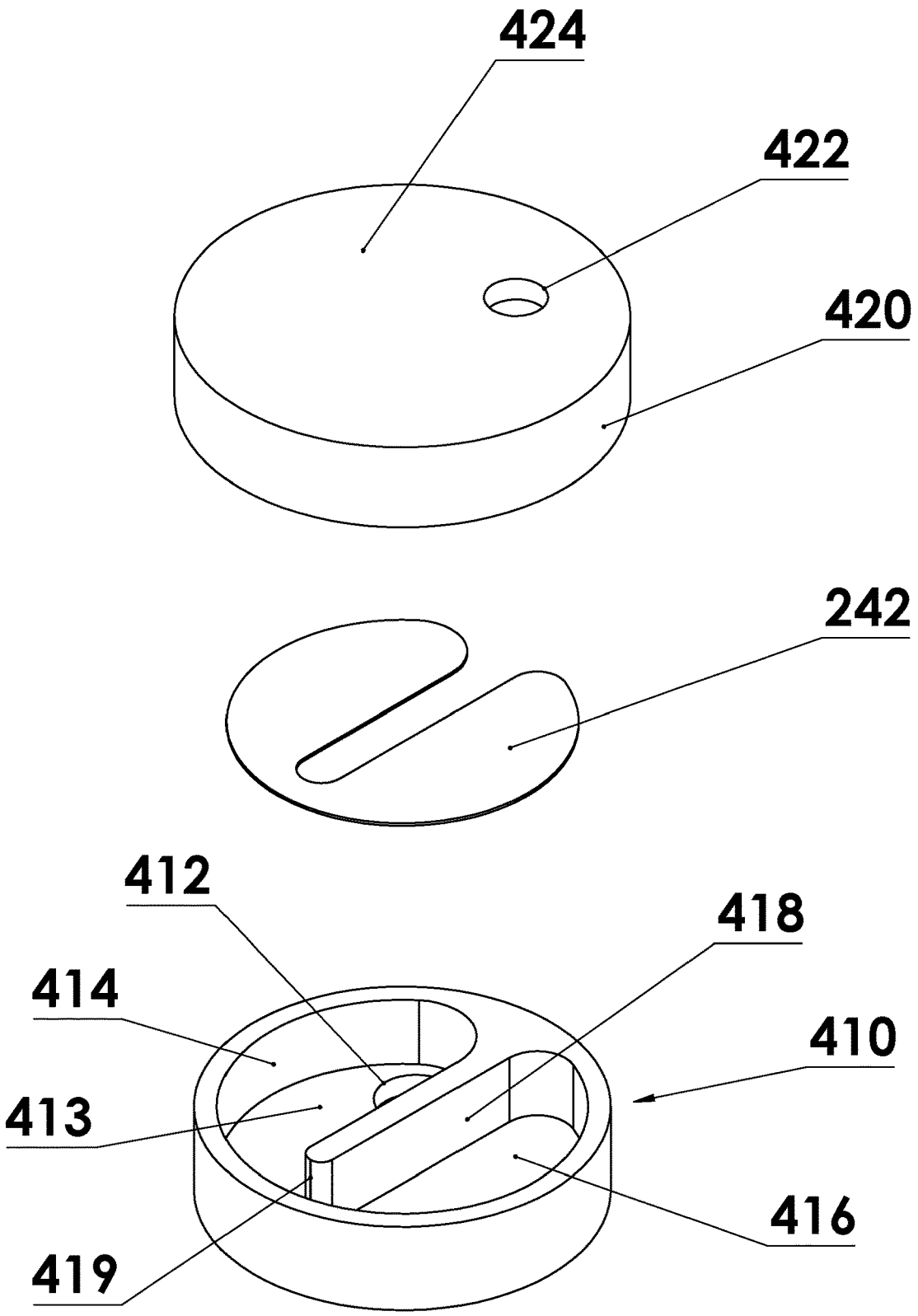
FIG. 26 is an exploded view of the induction cavity.

As illustrated in FIG. 26, the induction cavity (241) comprises a male cap (410), female receiving cap (420), and target workpiece (242). The male piece (410) comprises an inlet aperture (412) on its lower face (413), a first cavity (414), a second cavity (416), and dividing wall (418). Preferably, the dividing wall (418) does not fully close off the flow of material (281) from the first cavity (414) and second cavity (416). This can be achieved by machining the male cap (410) to leave a gap (419) between the first cavity (414) and second cavity (416). However, the gap (419) is not critical to the invention and the dividing wall (418) can fully wall off the first cavity (414) and the second cavity (416) and still achieve the same result. The target workpiece (242) is placed on top of the male cap (410). The target workpiece (242) is preferably butterflied but can be a solid disc or other shape as well. The female receiving cap (420), comprising an outlet aperture (422) on its upper face (424), is placed on top of the male cap (410) and the target workpiece (242). When the material enters the induction cavity (241) through inlet aperture (412), it is preferable for the inlet aperture (412) to be aligned with second cavity (416) so that the material spends as much time as possible in contact with the heated target workpiece (242).

Figure 27:
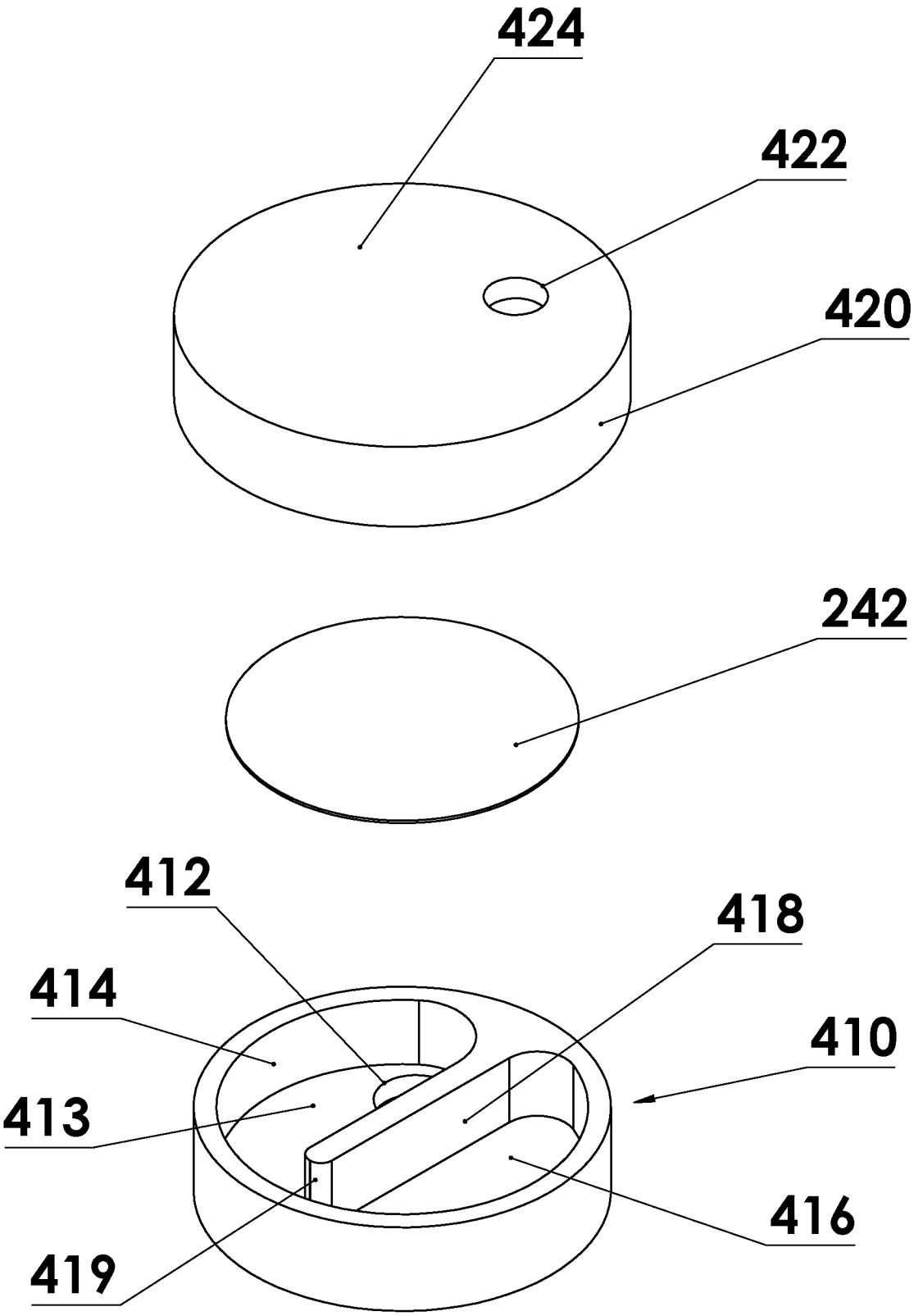
FIG. 27 is an exploded view of another embodiment of the induction cavity.

Illustrated in FIG. 27 is a second embodiment of the induction cavity in which the target workpiece (242) is a solid disc. The target workpiece (242) preferably has a diameter which is smaller than the diameter of the male cap (410) so that the material can pass around the edge of the target workpiece (242).

Figure 28:
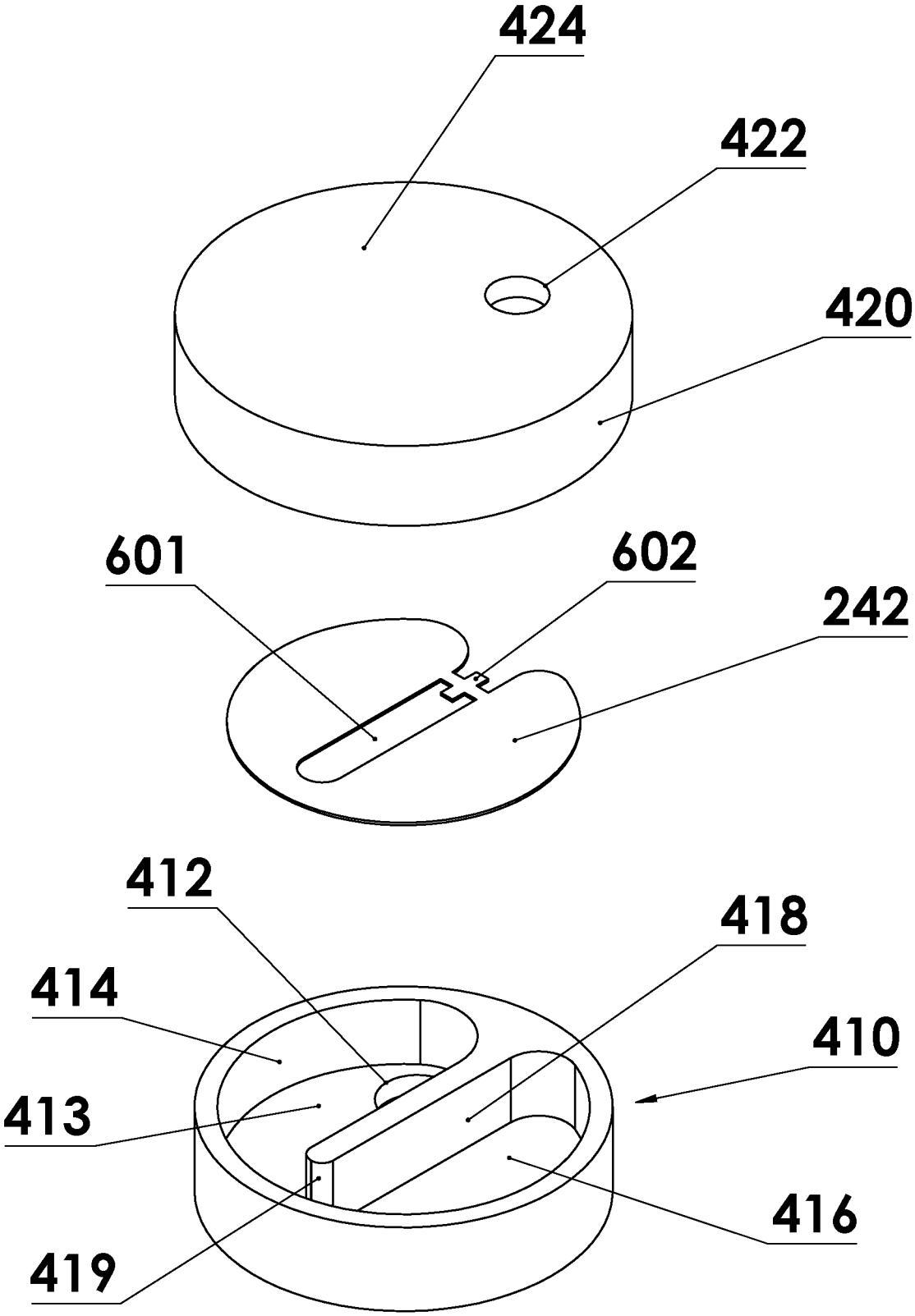
FIG. 28 is an exploded view of another embodiment of the induction cavity.

Illustrated in FIG. 28 is a third embodiment of the induction cavity in which the target workpiece (242) is configured with a slot (601) that is connected from one side to another by a device (602) that changes resistance with temperature. Device (602) can be a thermistor, either NTC (Negative Temperature Coefficient) or PTC (Positive Temperature Coefficient), a mechanical thermostat, resistive temperature detector or any other means for changing resistance with temperature either now known or later discovered. When the target workpiece (242) is located within the coil the total inductance changes corresponding to the resistance of the device. This provides direct feedback to the induction dispensing circuit as to the temperature of the target workpiece.

FIG. 29 illustrates a cross-section of an alternative embodiment of product container (200). In this embodiment, the material container (200) is inserted into dispenser (300) upside-down. It is preferable for the outlet (244) to be a duck-bill style spout to prevent leakage when the material (281) is at least semi-liquid. In this embodiment, the product container (200) contains a diaphragm (510) and check valve (520) which determines the volume of material (281) going through the induction cavity (241). A check valve outlet (530) siphons the material (281) to the induction cavity (241). A conduit (540) between the outlet aperture (422) of the induction cavity (241) and the outlet (244) of the product container (200) is necessary for the proper flow of material (281).

Figure 30:
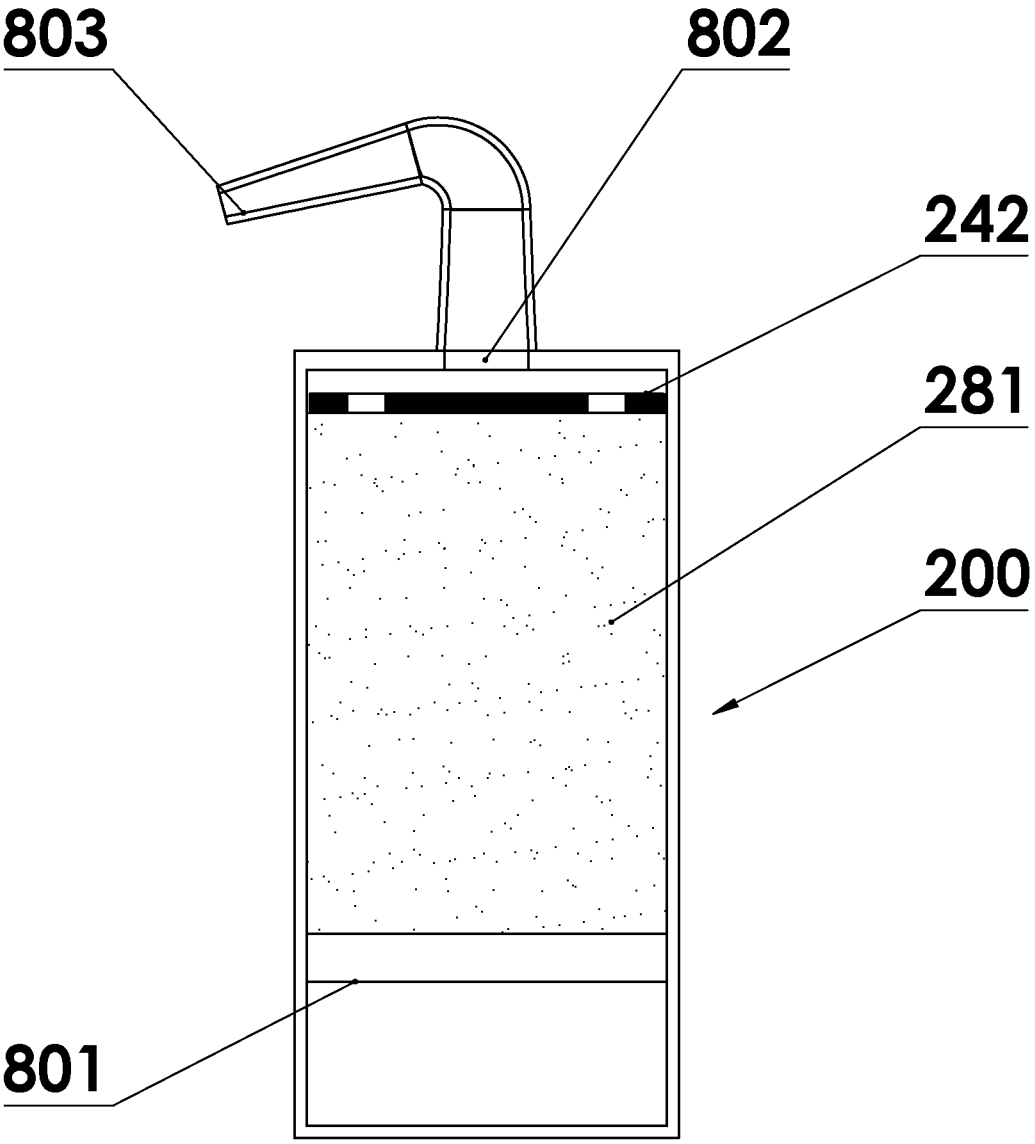
FIG. 30 is a cross-sectional view of another embodiment of the material container.

FIG. 30 illustrates a side section view of a second embodiment of the product container (200). In this embodiment the product container (200) does not possess an energy storing device such as a spring or the like for dispensing. This product container (200) is configured similar to a caulking tube in which a follower plate (801) must be actuated in order to dispense product. In this embodiment the target workpiece (242) lies in a region near the exit orifice (802). When the heating cycle begins the material (281) immediately in contact with the target workpiece (242) is heated thus lowering the viscosity. An external force is applied to the follower plate (801) in turn dispensing or expelling heated material (281) from the exit aperture (803).

Because only the material (281) within approximately 2-3 mm of the target workpiece (242) is heated the time required before heated material (281) may be used is minimized. Additionally, because only the material (281) to be used is heated the rest of the material (281) within the product container (200) maintains its original unheated state thereby preventing degradation of the material.

Figure 31:
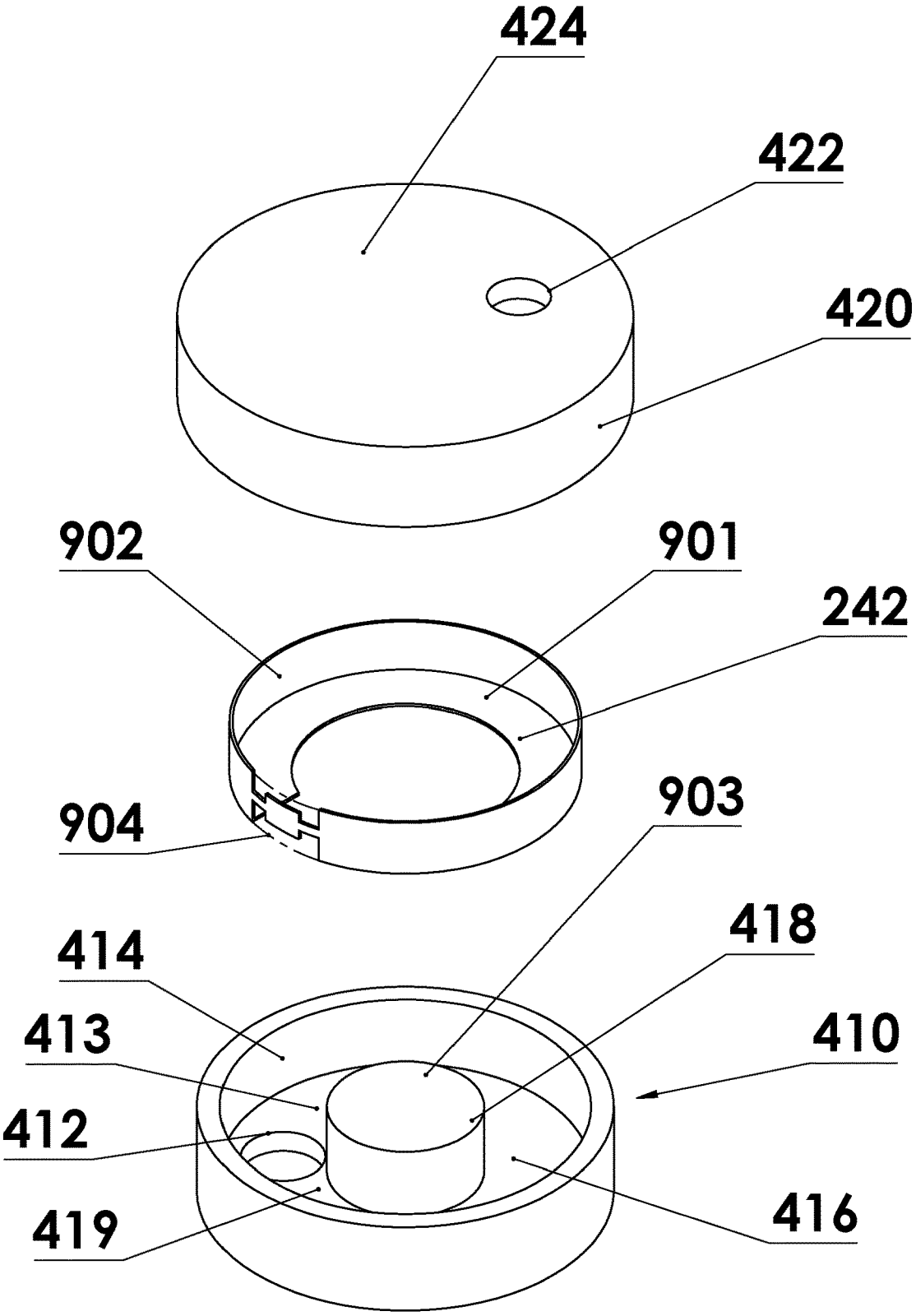
FIG. 31 is an exploded view of another embodiment of the induction cavity.

FIG. 31 shows another embodiment of the induction cavity (241) of the present invention in which the target workpiece (242) is an annular ring having a lower floor (901) and side walls (902). To maintain control of the flow of material across the surface of the target workpiece (242) a boss (903) is provided. The target workpiece (242) preferably has a diameter such that the lower floor (901) of the target workpiece (242) fits snugly around boss (903). The natural shape of the target workpiece (242) may be interrupted to incorporate a resistance device (904) that changes resistance with temperature. When the target workpiece (242) is located within the coil the total inductance changes corresponding to the resistance of the device. This provides direct feedback to the induction dispensing circuit as to the temperature of the target workpiece.

Figure 32:
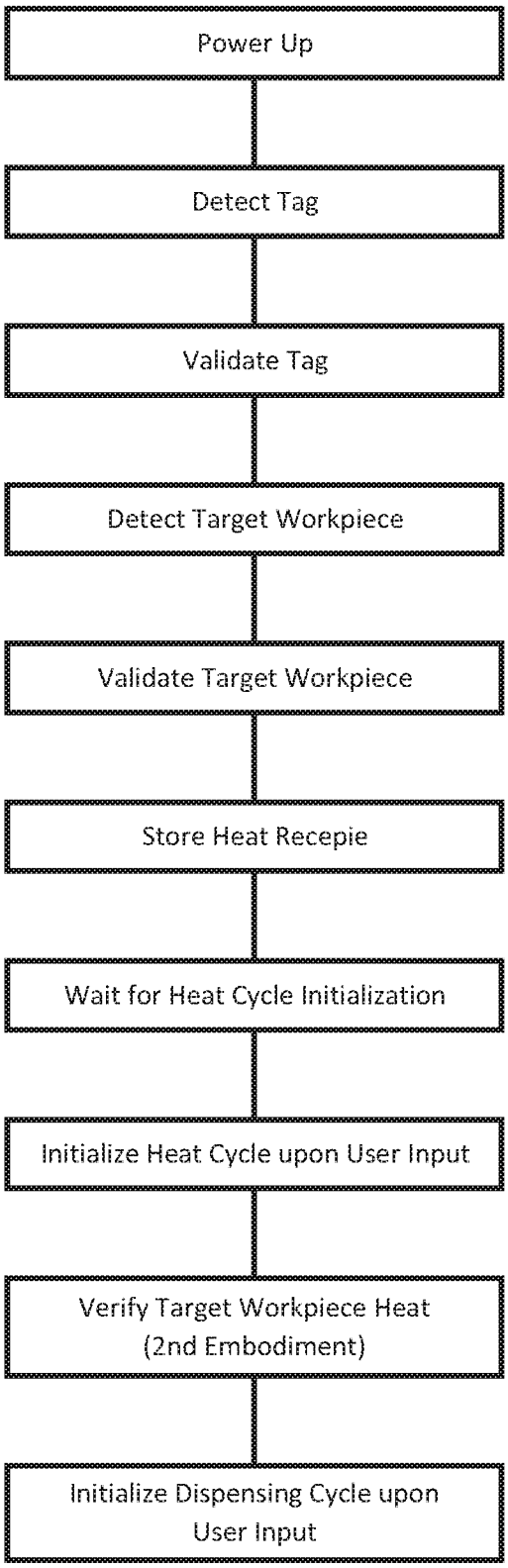
FIG. 32 is an operational flowchart of the induction dispenser.

FIG. 32 is a flow chart of the operation of the induction dispenser. FIG. 32 is a flow chart of the operation of the present invention. Upon being powered on the dispenser searches for an RFID tag. Once an RFID tag is detected, the RFID tag is read and if the sequence of information is correct, it is determined to be valid. Once the RFID tag has been deemed valid by the dispenser the resonant frequency is measured to verify the presence of a target workpiece and also that the target workpiece matches the criteria held within the RFID tag. If all previously stated criteria has been deemed within the tolerance as found within the RFID tag, the heat recipe is measured and stored within the device. Upon activation of the heat cycle, the induction dispenser provides heat as determined by said heat recipe. In one embodiment of the present invention the target workpiece comprises a device that changes resistance with temperature. In such an embodiment, data is stored on the RFID tag defining the relationship of the temperature of the target workpiece to tank resonant frequency to coil current. As a result, the induction device measures the current drawn by the coil and resonant frequency to determine and control the target workpiece temperature. Upon completion of the cycle, per the instructions held by the RFID tag, the induction dispenser waits for user input to dispense the heated material. The previously described heating cycle is repeated until the RFID tag is no longer detected or when the dispenser is powered down. At which point, the cycle starts back at the beginning, or top, of the flow diagram.

The foregoing merely illustrates the principles of the invention. Various modifications and alterations to the described embodiments will be apparent to those skilled in the art in view of the teachings herein. It will thus be appreciated that those skilled in the art will be able to devise numerous systems, arrangements and methods which, although not explicitly shown or described herein, embody the principles of the invention and are thus within the spirit and scope of the present invention. In addition, all publications and patent documents referenced herein are incorporated herein by reference in their entireties.

What is claimed is:

1. An induction heating device adapted to heat shaving or cosmetic products comprising:

a housing defining an induction housing, a non-electrically conductive product container for holding the product, said product container being removably received in said induction housing and further comprising an RF module for transmitting and receiving information to and from a microprocessor for remotely controlling electronic circuit, an induction coil adjacent to said induction housing for generating an electromagnetic field into said product container, an electrically conductive target member in said product container comprising a metallic disc having a cross-section complementally-configured to the cross-section of the product container, the cross-section of the metallic disc being slightly less than the cross-section of the product container thereby permitting said metallic disc to freely descend within said product container as said product is used; and an electromagnetic field activator mounted in said housing and connected to said induction coil, said target member being heated during a heating cycle for a predetermined time period in response to said electromagnetic field from said induction coil to heat and/or melt the product.

2. The induction-heating device adapted to heat shaving or cosmetic products as claimed in claim 1, wherein said product container further comprises a top product surface and a heat affected product zone consisting of a layer of said product immediately below said top product surface that is heated by said target member allowing heated material to flow through said target member to be collected by a user for shaving or cosmetic purposes.

3. The induction-heating device adapted to heat shaving or cosmetic products as claimed in claim 2 and further comprising:

said housing having a top surface;

said induction housing comprising a side wall, a bottom wall and an open top mounted in said top surface, said induction housing side wall defining an interior surface having a uniform cross-section from said open to top said bottom wall said product container comprises a side wall, a bottom wall and a closable open top, said product container side wall defining an exterior surface having a uniform cross-section complementally configured to said interior surface of said induction housing, said product container being removably inserted in said induction housing.

4. The induction-heating device adapted to heat shaving or cosmetic products as claimed in claim 3, wherein said product container side wall defining an interior surface having a uniform cross-section from said closable open top to said bottom wall, said electrically conductive metallic target member further comprises a peripheral surface complementally configured to said interior surface of said product container.

5. The induction-heating device adapted to heat shaving or cosmetic products as claimed in claim 4, wherein said induction housing comprises a first cylindrically shaped cut and said product container comprises a second cylindrically shaped cup.

6. The induction-heating device adapted to heat shaving or cosmetic products as claimed in claim 5 wherein said first and second cylindrically shaped cups and target member are configured to maintain alignment and prevent rotation therebetween during use.

7. The induction-heating device adapted to heat shaving or cosmetic products as claimed in claim 6, wherein said first and second cylindrically shaped cups have flat sidewall sections and said target member peripheral surface has a flat section aligned with said flat sidewall sections to maintain said alignment and prevent rotation therebetween during use.

8. The induction-heating device adapted to heat shaving or cosmetic products as claimed in claim 2, further comprising means for supplying an alternating current source or a direct current source to electronic circuitry.

9. The induction-heating device adapted to heat shaving or cosmetic products as claimed in claim 8, wherein said electronic circuitry includes means for generating high frequency electromagnetic energy into said electrically conductive metallic target member, said electronic circuitry further including means for regulating said alternating current or direct current to modulate the heat generated inside said cylindrically conductive metallic target member.

10. The induction-heating device adapted to heat shaving or cosmetic products as claimed in claim 9, wherein said means comprises a microprocessor, high frequency inverter circuit, resonant tank circuit and said induction coil.

11. The induction-heating device adapted to heat shaving or cosmetic products as claimed in claim 10, further comprising an operator interface connected to said microprocessor for permitting a user to manually start and stop a heating cycle, for adjusting the energy level and duration of heat during a heating cycle, and for displaying helpful information based on the energy level, temperature, or duration of the heating cycle.

12. The induction-heating device adapted to heat shaving or cosmetic products as claimed in claim 11, further comprising at least one current sensor and at least one temperature sensor for monitoring currents and temperatures of the electronic circuitry.

13. The induction-heating device adapted to heat shaving or cosmetic products as claimed in claim 12, further comprising visual and/or acoustical alarm means responsive to said current and temperature sensors for indicating overcurrents or over-heating temperatures of the electronic circuitry.

14. The induction-heating device adapted to heat shaving or cosmetic products as claimed in claim 1, further comprising a speaker for transmitting information received via said RF module, such information relating to the start and stop of a heating cycle or the adjusted energy level and duration of heat during a heating cycle or temperature and current sensing levels.

15. The induction-heating device adapted to heat shaving or cosmetic products as claimed in claim 1, wherein said metallic disc comprises a donut-shaped disc.

16. The induction-heating device adapted to heat shaving or cosmetic products as claimed in claim 1, wherein said metallic disc comprises at least one hole extending therethrough, at least one slot extending therethrough, or a combination of at least one hole and at least one slot extending therethrough.

17. The induction-heating device adapted to heat shaving or cosmetic products as claimed in claim 1, wherein said metallic disc comprises at least one element located on said upper surface adjacent to said at least one hole and extending normal to the plane of said upper surface.

18. The induction-heating device adapted to heat shaving or cosmetic products as claimed in claim 17, wherein said at least one element comprises a rib.

19. The induction-heating device adapted to heat shaving or cosmetic products as claimed in claim 1, wherein said metallic disc is comprised of stainless steel or aluminum.

* * * * *